US011161317B2

(12) United States Patent
Graham et al.

(10) Patent No.: US 11,161,317 B2
(45) Date of Patent: Nov. 2, 2021

(54) METHODS AND A MACHINE FOR FORMING A CONTAINER FROM A BLANK

(71) Applicant: WESTROCK SHARED SERVICES, LLC, Atlanta, GA (US)

(72) Inventors: Thomas Dean Graham, Winter Garden, FL (US); Amer Aganovic, Orlando, FL (US); Ricki D. Anderson, Westerville, OH (US); Jeffrey H. Chapman, Villa Hills, KY (US)

(73) Assignee: WESTROCK SHARED SERVICES, LLC, Atlanta, GA (US)

( * ) Notice: Subject to any disclaimer, the term of this patent is extended or adjusted under 35 U.S.C. 154(b) by 161 days.

(21) Appl. No.: 15/983,996

(22) Filed: May 18, 2018

(65) Prior Publication Data

US 2018/0264767 A1 Sep. 20, 2018

Related U.S. Application Data

(63) Continuation of application No. 14/692,947, filed on Apr. 22, 2015, now abandoned, which is a (Continued)

(51) Int. Cl.
*B31B 50/00* (2017.01)
*B31B 50/30* (2017.01)

(Continued)

(52) U.S. Cl.
CPC ..... *B31B 50/30* (2017.08); *B65D 5/0227* (2013.01); *B31B 50/006* (2017.08); *B31B 50/07* (2017.08);

(Continued)

(58) Field of Classification Search
CPC .. B31B 1/28; B31B 3/00; B31B 50/28; B31B 2201/2604; B31B 2203/084

(Continued)

(56) References Cited

U.S. PATENT DOCUMENTS 2,168,543 A * 8/1939 Vergobbi ..... B29C 65/7885 493/133
RE23,046 E 10/1948 Blanchet (Continued)

OTHER PUBLICATIONS

Office Action, dated May 28, 2015, for co-pending Mexican patent application No. MX/a/2010/012003, with English-language translation.

(Continued)

*Primary Examiner* — Eyamindae C Jallow
(74) *Attorney, Agent, or Firm* — Neil G. Cohen

(57) ABSTRACT

A machine a mandrel assembly includes a mandrel having an external shape complimentary to an internal shape of at least a portion of a container, a first lift mechanism operatively coupled to a first servomechanism to wrap a first portion of a blank about the mandrel, a second lift mechanism operatively coupled to a second servomechanism to wrap a second portion of the blank about the mandrel, and a folding arm coupled to the first lift mechanism and operatively coupled to a third servomechanism. A control system is in communication with the first servomechanism, the second servomechanism, and the third servomechanism and is configured to transmit a signal to each of the servomechanisms to independently control movement of the first lift mechanism, the second lift mechanism, and the folding arm to wrap at least the first and second portions of the blank about the mandrel to form the container.

13 Claims, 35 Drawing Sheets

Related U.S. Application Data continuation of application No. 12/915,862, filed on Oct. 29, 2010, now Pat. No. 9,022,913.

(60) Provisional application No. 61/257,359, filed on Nov. 2, 2009.

(51) Int. Cl.

| | |
|---|---|
| ***B65D 5/02*** | (2006.01) |
| *B31B 50/28* | (2017.01) |
| *B31B 50/44* | (2017.01) |
| *B31B 50/64* | (2017.01) |
| *B31B 100/00* | (2017.01) |
| *B31B 50/07* | (2017.01) |
| *B31B 110/30* | (2017.01) |

(52) U.S. Cl.
CPC ..... *B31B 50/28* (2017.08); *B31B 50/282* (2017.08); *B31B 50/44* (2017.08); *B31B 50/64* (2017.08); *B31B 2100/00* (2017.08); *B31B 2100/0022* (2017.08); *B31B 2110/30* (2017.08)

(58) Field of Classification Search
USPC ..... 493/51, 69, 79, 105, 107, 162, 164, 175
See application file for complete search history.

(56) References Cited

U.S. PATENT DOCUMENTS

| | | | | |
|---|---|---|---|---|
| 2,967,655 | A | 1/1961 | Seger, Jr. | |
| 3,683,755 | A | 8/1972 | Lattke | |
| 4,066,008 | A | 1/1978 | Arvanigian | |
| 4,242,949 | A * | 1/1981 | Auckenthaler | B31F 1/0054 493/276 |
| 4,349,345 | A | 9/1982 | Bodendoerfer | |
| 4,392,607 | A | 7/1983 | Perkins, Jr. | |
| 4,409,045 | A | 10/1983 | Busse | |
| 4,452,596 | A | 6/1984 | Clauss et al. | |
| 4,708,706 | A * | 11/1987 | Doderer | B31B 50/00 493/164 |
| 4,828,244 | A | 5/1989 | Sardella | |
| 4,932,930 | A * | 6/1990 | Coalier | B31B 50/00 493/128 |
| 4,936,815 | A * | 6/1990 | Kirkland | B31B 50/00 493/125 |
| 5,035,683 | A | 7/1991 | Takeda et al. | |
| 5,046,662 | A | 9/1991 | Cowles | |
| 5,139,196 | A | 8/1992 | Fry et al. | |
| 5,147,271 | A * | 9/1992 | Bacques | B65D 5/001 493/176 |
| 5,160,307 | A | 11/1992 | Bacques et al. | |
| 5,234,398 | A | 8/1993 | Larsen | |
| 5,241,250 | A * | 8/1993 | Nagasawa | G05B 19/4141 318/53 |
| 5,242,364 | A | 9/1993 | Lehmann | |
| 5,256,129 | A | 10/1993 | Boix Jaen | |
| 5,350,348 | A | 9/1994 | Guot | |
| 5,400,955 | A | 3/1995 | Coalier et al. | |
| 5,474,203 | A | 12/1995 | Baker | |
| 5,593,375 | A | 1/1997 | Franci | |
| 5,624,368 | A | 4/1997 | Cromwell | |
| 5,656,006 | A | 8/1997 | East et al. | |
| 5,704,541 | A * | 1/1998 | Mogard | B65D 5/746 229/125.15 |
| 5,735,785 | A | 4/1998 | Lucas et al. | |
| 5,827,162 | A | 10/1998 | Rubin et al. | |
| 5,867,966 | A | 2/1999 | Mogard | |
| 5,876,319 | A | 3/1999 | Holton | |
| 5,916,079 | A | 6/1999 | Haring et al. | |
| 5,938,108 | A | 8/1999 | Williams et al. | |
| 5,941,452 | A | 8/1999 | Williams et al. | |
| 5,980,440 | A | 11/1999 | Mitman et al. | |
| 5,992,489 | A | 11/1999 | Busse | |
| 6,048,421 | A | 4/2000 | White | |
| 6,106,450 | A | 8/2000 | Brittain | |
| 6,206,816 | B1 | 3/2001 | Cook et al. | |
| 6,267,715 | B1 | 7/2001 | Sass et al. | |
| 6,319,183 | B1 | 11/2001 | Ballos, III | |
| 6,385,950 | B1 | 5/2002 | Anderson | |
| 6,387,028 | B1 | 5/2002 | Nishio et al. | |
| 6,689,034 | B2 | 2/2004 | Walsh et al. | |
| 6,743,191 | B1 | 6/2004 | Chang | |
| 6,827,678 | B1 | 12/2004 | Kuempel | |
| 7,322,171 | B2 | 1/2008 | Bonnain et al. | |
| 7,322,919 | B2 | 1/2008 | Malini | |
| 7,331,289 | B2 | 2/2008 | Albrecht et al. | |
| 7,338,422 | B2 | 3/2008 | Diehr et al. | |
| 7,445,589 | B2 | 11/2008 | Jaen | |
| 7,717,838 | B2 | 5/2010 | Strong et al. | |
| 7,857,743 | B2 | 12/2010 | Barner | |
| 7,935,041 | B2 | 5/2011 | Graham et al. | |
| 8,105,223 | B2 | 1/2012 | Graham et al. | |
| 8,323,165 | B2 | 12/2012 | Atoui | |
| 8,485,420 | B2 | 7/2013 | Barner | |
| 2003/0119640 | A1 | 6/2003 | Jaen | |
| 2003/0192945 | A1 | 10/2003 | Quaintance | |
| 2004/0188504 | A1 | 9/2004 | Pierce | |
| 2005/0159283 | A1 | 7/2005 | Jaen | |
| 2007/0037682 | A1 | 2/2007 | Scholtes et al. | |
| 2007/0142193 | A1 | 6/2007 | Strong et al. | |
| 2007/0191201 | A1 | 8/2007 | Reuteler et al. | |
| 2008/0039308 | A1 | 2/2008 | Herrin | |
| 2008/0078819 | A1 * | 4/2008 | Strong | B65D 5/029 229/109 |
| 2008/0099541 | A1 * | 5/2008 | Smith | B65D 5/06 229/109 |
| 2008/0120947 | A1 | 5/2008 | Martin et al. | |
| 2008/0120948 | A1 | 5/2008 | Martin et al. | |
| 2008/0250759 | A1 | 10/2008 | Cash | |
| 2009/0098991 | A1 | 4/2009 | Graham et al. | |
| 2010/0219232 | A1 | 9/2010 | Smith | |
| 2011/0065559 | A1 | 3/2011 | Atoui | |
| 2011/0281705 | A1 | 11/2011 | Aganovic et al. | |
| 2012/0100976 | A1 | 4/2012 | Graham et al. | |

OTHER PUBLICATIONS

Canadian Office Action, dated Jun. 20, 2014, for co-pending Canadian patent application No. 2603354 (3 pgs).
MX Office Action Summary Letter; dated Oct. 12, 2011; 4 pages.

* cited by examiner

METHODS AND A MACHINE FOR FORMING A CONTAINER FROM A BLANK

CROSS REFERENCE TO RELATED APPLICATIONS

This application is a continuation application of U.S. patent application Ser. No. 14/692,947, filed Apr. 22, 2015, entitled "METHODS AND A MACHINE FOR FORMING A CONTAINER FROM A BLANK," which is a continuation application of U.S. patent application Ser. No. 12/915,862, filed Oct. 29, 2010, entitled "METHODS AND A MACHINE FOR FORMING A CONTAINER FROM A BLANK," which claims the priority of U.S. Provisional Patent Application Ser. No. 61/257,359, filed Nov. 2, 2009, the disclosures of each of which are hereby incorporated by reference in their entireties.

BACKGROUND OF THE INVENTION

This invention relates generally to a machine for forming containers formed from a blank of sheet material, and more specifically to methods and a machine having a control system that is used to form a corrugated container from a blank of sheet material by wrapping the blank around a mandrel.

Containers fabricated from paperboard and/or corrugated paperboard material are often used to store and transport goods. These containers can include four-sided containers, six-sided containers, eight-sided containers, bulk bins and/or various size corrugated barrels. Such containers are usually formed from blanks of sheet material that are folded along a plurality of preformed fold lines to form an erected corrugated container.

At least some known containers are formed using a machine. For example, a blank may be positioned near a mandrel on a machine, and the machine may be configured to wrap the blank around the mandrel to form at least a portion of the container. An example of such a machine is shown in U.S. Pat. No. 4,242,949 ("the '949 patent"). The '949 patent describes a machine that is capable of producing a cardboard case or similar container by wrapping a blank about a mandrel. This mandrel has an essentially square or rectangular cross section, so that the cases formed by the machine have four lateral faces defining a volume whose cross section, parallel to the bottom of the cases, is also square or rectangular. In other words, this machine forms a four-sided, square, or rectangular box. The machine uses jacks and mechanical linkages to raise, lower and rotate folding arms that wrap the blank around the mandrel. These arms are rigidly connected together so that they move in tandem, and cannot be moved or controlled independently.

Another box forming machine is described in U.S. Pat. No. 5,147,271 ("the '271 patent"). The '271 patent describes a machine having an eight-sided mandrel that is capable of producing a cardboard case or similar container by wrapping a blank about the mandrel. Thus, this machine is able to form containers having eight side faces defining a volume whose cross section, parallel to the bottom of the container is also eight-sided. As in the case of the '949 patent, the '271 patent also describes a machine that uses jacks and mechanical linkages to raise, lower and rotate folding arms that wrap the blank around the mandrel. These arms are rigidly connected together so that they move in tandem, and cannot be moved or controlled independently.

Another box forming machine is described in U.S. Pub. No. 2008/0078819 ("the '819 application"). The '819 application describes a machine for forming a barrel from a blank of sheet material. The machine includes a mandrel having an external shape complimentary to an internal shape of at least a portion of the barrel. The barrel that is formed is an eight-sided barrel. Thus, the mandrel is also eight-sided. Unlike in the '949 patent and the '271 patent, the '819 application describes a servomechanism operatively connected to a folding arm for driving and controlling movement of the arm. However, the machine described in the '819 application is limited because each folding arm is not individually controlled by separate servomechanisms. Rather, at least some of the arms of the '819 application are described as rigidly connected together so that they move in tandem, and cannot be moved or controlled independently.

None of the known box forming machines include a mandrel, a plurality of folding arms, and a plurality of blank feeding arms that are each individually controlled by a servomechanism, and a control system for controlling each of the servomechanisms. It would be beneficial to have a box forming machine that includes individually controlled arms and a control system that allows an operator to program different box forming recipes, or protocols, into the control system. Each recipe would include computer-readable instructions that instruct the different servomechanisms of the box forming arms to form various size boxes, various types of boxes, and/or control the output of the formed boxes from the machine. The servomechanisms of the arms would be controlled by the control system such that the arms could follow any movement path desired by the operator. Thus, the machine could easily form any type or size of box with minimal mechanical changes to the machine. Such a box forming machine would also be beneficial because it would allow an operator to improve the output of boxes formed by the machine because each forming arm would be individually controlled.

BRIEF DESCRIPTION OF THE INVENTION

In one aspect, a machine for forming a container from a blank of sheet material is provided. The machine includes a frame and a mandrel assembly mounted to the frame. The mandrel assembly includes a mandrel having an external shape complimentary to an internal shape of at least a portion of the container, a first lift mechanism operatively coupled to a first servomechanism and configured to wrap a first portion of the blank about the mandrel, a second lift mechanism operatively coupled to a second servomechanism and configured to wrap a second portion of the blank about the mandrel, and a folding arm coupled to the first lift mechanism and operatively coupled to a third servomechanism. The machine further includes a control system in communication with the first servomechanism, the second servomechanism, and the third servomechanism. The control system is configured to transmit a signal to each of the servomechanisms to independently control movement of the first lift mechanism, the second lift mechanism, and the folding arm to wrap at least the first and second portions of the blank about the mandrel to form the container.

In another aspect, a method for forming a container from a blank of sheet material using a machine is provided. The machine includes a servo-controlled transfer assembly, a mandrel assembly, a servo-controlled lateral presser arm adjacent the mandrel assembly, and a servo-controlled folding arm adjacent the mandrel assembly. The method includes positioning the blank under the mandrel assembly using the servo-controlled transfer assembly, wrapping a first portion of the blank about the mandrel assembly using the servo-controlled lateral presser arm, and wrapping a second portion of the blank about the mandrel assembly using the servo-controlled folding arm. The servo-controlled folding arm is controlled independently of the servo-controlled lateral presser arm. The method further includes ejecting the container from the mandrel assembly after the first portion and the second portion of the blank are wrapped about the mandrel assembly.

In still another aspect, a control system for controlling a machine configured to form a container from a blank of sheet material is provided. The control system includes a computer program embodied on a computer-readable medium for instructing the control system. The control system is configured to transmit a first signal to a transfer assembly to instruct the transfer assembly to transfer the blank to a mandrel assembly of the machine, transmit a second signal to a first servomechanism to control a first lift mechanism to wrap a first portion of the blank about the mandrel assembly, transmit a third signal to a second servomechanism to control a second lift mechanism to wrap a second portion of the blank about the mandrel assembly, and transmit a fourth signal to a third servomechanism to control a folding arm coupled to the second lift mechanism to wrap the second portion of the blank about the mandrel assembly. The first lift mechanism, the second lift mechanism, and the folding arm are independently controlled by the control system.

DETAILED DESCRIPTION OF THE INVENTION

The methods and machine for forming corrugated containers described herein overcome the limitations of known box forming machines. The methods and machine described herein include an independently controlled folding arm, lifting mechanisms, lateral presser arm, blank feeding mechanisms, under plate, bottom flap presser plate, glue tab folder, and glue tab presser that facilitate wrapping the blank around a mandrel to form the container. The independently controlled devices are controlled using servomechanisms, also referred to herein as "servos." As used herein, the term "servo-controlled" refers to any component and/or device having its movement controlled by a servomechanism.

As described herein, a control system allows an operator to change recipes or protocols by making a selection on a user interface. The recipes are computer instructions for controlling the machine to form different size boxes, different types of boxes, and/or control the output of the formed containers. The different recipes control the speed, timing, force applied, and/or other motion characteristics of the different forming components of the machine including how the components move relative to one another. However, the processes and systems described herein are not limited in any way to the corrugated container shown herein. Rather, the processes and systems described herein can be applied to a plurality of container types manufactured from a plurality of materials.

Figure 1:
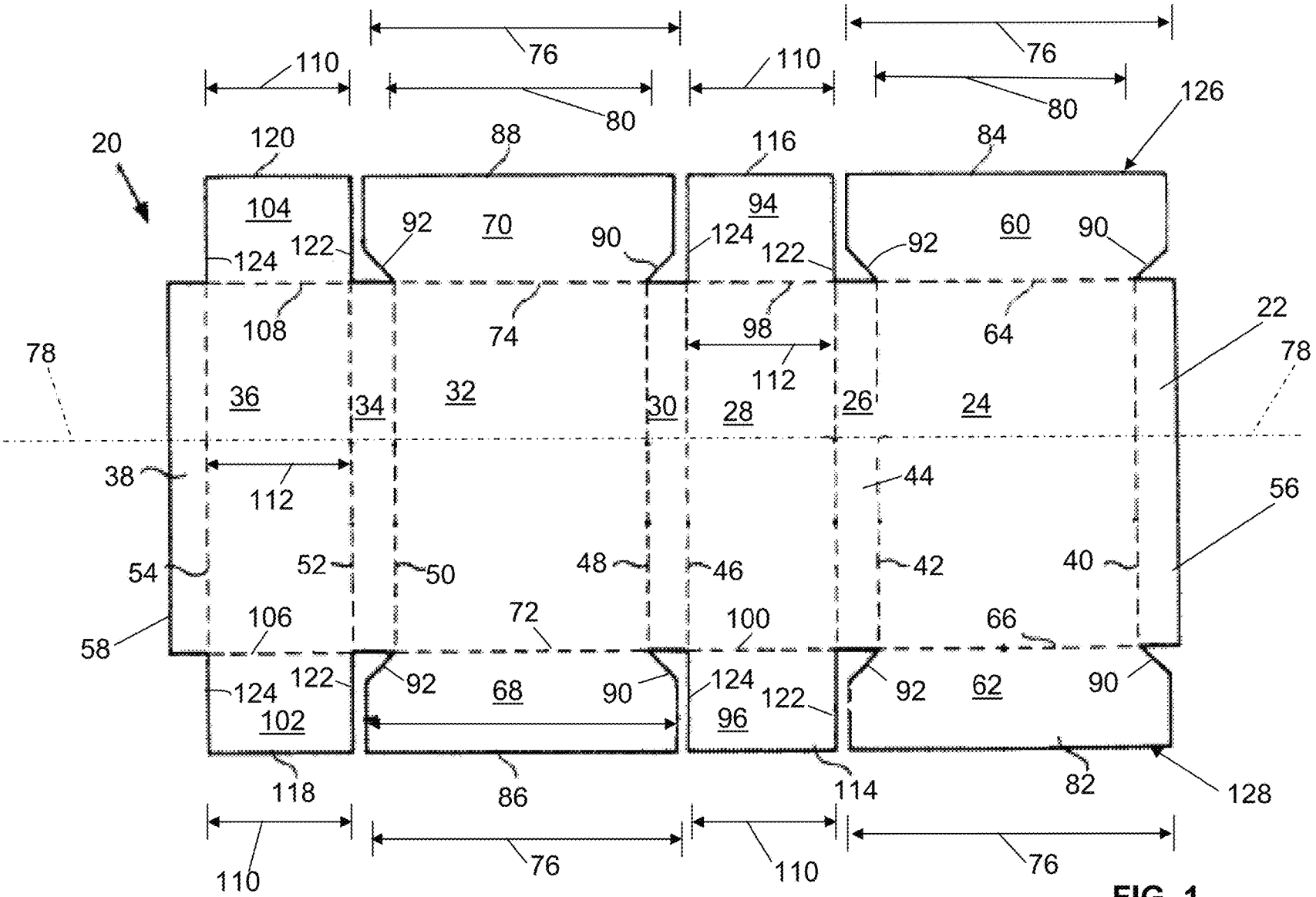
FIG. 1 is a top plan view of an exemplary embodiment of a blank of sheet material that may be used with the machine described herein.

FIG. 1 illustrates a top plan view of an exemplary embodiment of a substantially flat blank 20 of sheet material. As shown in FIG. 1, blank 20 includes a series of aligned wall panels and end panels connected together by a plurality of preformed, generally parallel, fold lines. The aligned panels include a series of wall panels connected together by a plurality of preformed, generally parallel, fold lines. Specifically, the wall panels include a first corner panel 22, a first side panel 24, a second corner panel 26, a first end panel 28, a third corner panel 30, a second side panel 32, a fourth corner panel 34, a second end panel 36, and a glue panel 38 connected in series along a plurality of fold lines 40, 42, 44, 46, 48, 50, 52, and 54. First corner panel 22 extends from a first free edge 56 to fold line 40, first side panel 24 extends from first corner panel 22 along fold line 40, second corner panel 26 extends from first side panel 24 along fold line 42, first end panel 28 extends from second corner panel 26 along fold line 44, third corner panel 30 extends from first end panel 28 along fold line 46, second side panel 32 extends from third corner panel 30 along fold line 48, fourth corner panel 34 extends from second side panel 32 along fold line 50, second end panel 36 extends from fourth corner panel 34 along fold line 52, and glue panel 38 extends from second end panel 36 along fold line 54 to a second free edge 58.

A first top side panel 60 and a first bottom side panel 62 extend from opposing edges of first side panel 24. More specifically, first top side panel 60 and first bottom side panel 62 extend from first side panel 24 along a pair of opposing preformed, generally parallel, fold lines 64 and 66, respectively. Similarly, a second bottom side panel 68 and a second top side panel 70 extend from opposing edges of second side panel 32. More specifically, second bottom side panel 68 and second top side panel 70 extend from second side panel 32 along a pair of opposing preformed, generally parallel, fold lines 72 and 74, respectively. Fold lines 64, 66, 72, and 74 are generally parallel to each other and generally perpendicular to fold lines 40, 42, 48, and 50. First bottom side panel 62 and first top side panel 60 each have a width 76 taken along a central horizontal axis 78 of blank 20 that is greater than a width 80 of first side panel 24, also taken along central horizontal axis 78. Similarly, second bottom side panel 68 and second top side panel 70 each have width 76 that is greater than width 80 of second side panel 32, taken along central horizontal axis 78.

First bottom side panel 62 and first top side panel 60 each include a free edge 82 or 84, respectively. Similarly, second bottom side panel 68 and second top side panel 70 each include a free edge 86 or 88, respectively. Bottom side panels 62 and 68 and top side panels 60 and 70 each include opposing angled edge portions 90 and 92 that are each obliquely angled with respect to respective fold lines 64, 66, 72, and/or 74. Although other angles may be used without departing from the scope of the present invention, in one embodiment, edge portions 90 and 92 are angled at about 45° with respect to respective fold lines 64, 66, 72, and/or 74.

Figure 3:
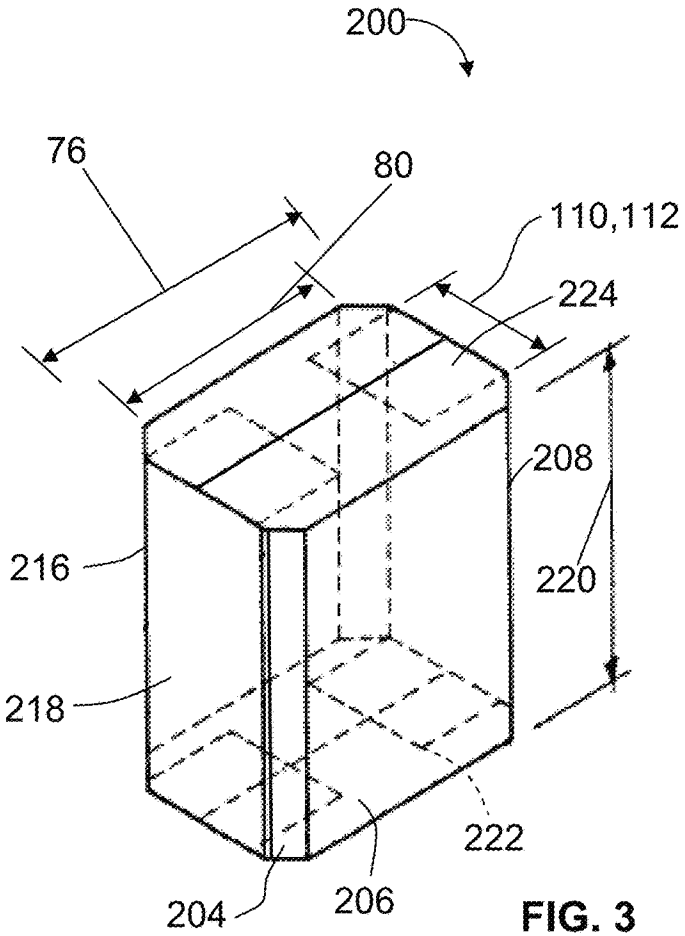
FIG. 3 is a perspective view of the container shown in FIG. 2 in a closed state.
Figure 2:
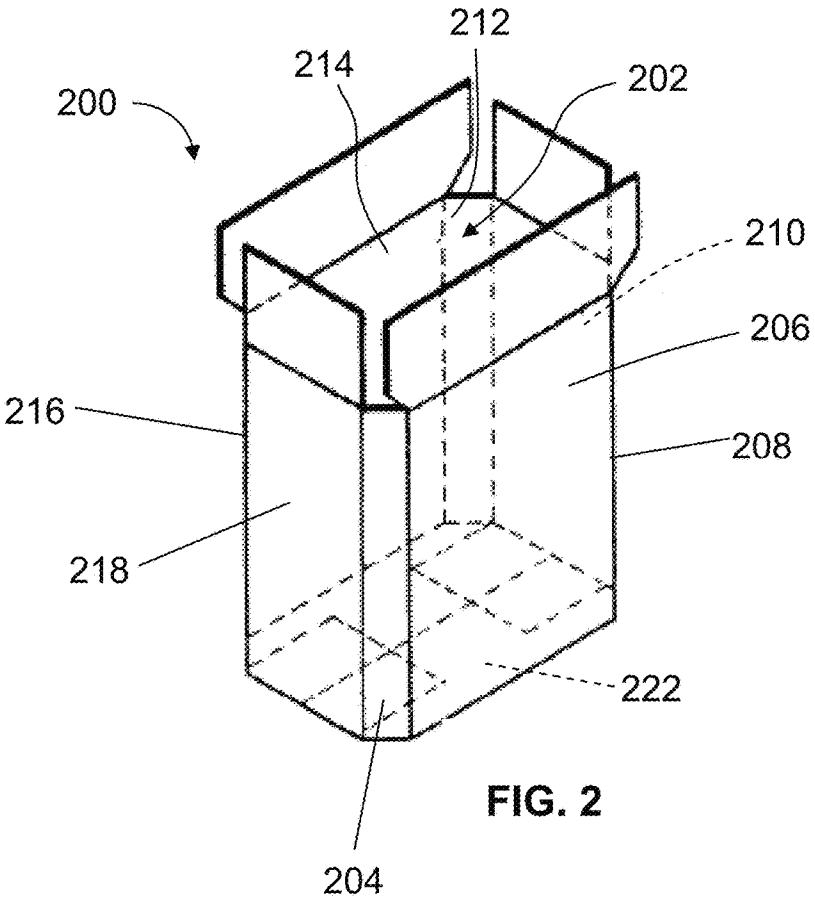
FIG. 2 is perspective view of an exemplary embodiment of a container that may be formed from the blank shown in FIG. 1.
Figure 4:
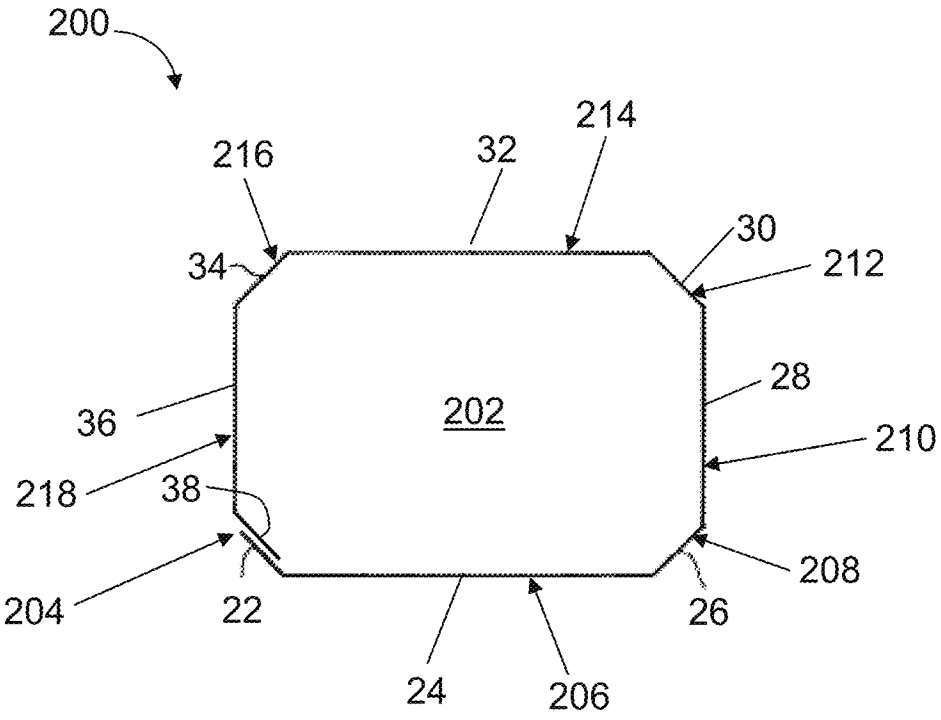
FIG. 4 is an overhead cross-sectional view of the container shown in FIG. 3.

As will be described in more detail below, the shape, size, and arrangement of bottom side panels 62 and 68 and top side panels 60 and 70 as shown in FIG. 1 and described above facilitates forming an octagonal container 200 having angled corners, an example of which is shown in FIGS. 2-4. More specifically, the shape, size, and arrangement of bottom side panels 62 and 68 and top side panels 60 and 70 facilitates forming container 200 having corner walls that are obliquely angled with respect to, and interconnect side walls and end walls of formed container 200.

As shown in FIG. 1, a first top end panel 94 and a first bottom end panel 96 extend from opposing edges of first end panel 28. More specifically, first top end panel 94 and first bottom end panel 96 extend from first end panel 28 along a pair of opposing preformed, generally parallel, fold lines 98 and 100, respectively. Similarly, a second bottom end panel 102 and a second top end panel 104 extend from opposing edges of second end panel 36. More specifically, second bottom end panel 102 and second top end panel 104 extend from second end panel 36 along a pair of opposing preformed, generally parallel, fold lines 106 and 108, respectively. Fold lines 98, 100, 106, and 108 are generally parallel to each other and generally perpendicular to fold lines 44, 46, 52, and 54. First bottom end panel 96 and first top end panel 94 each have a width 110 taken along central horizontal axis 78 of blank 20 that is substantially equal to a width 112 of first end panel 28, also taken along central horizontal axis 78. Similarly, second bottom end panel 102 and second top end panel 104 each have width 110 that is greater than width 112 of second end panel 36, taken along central horizontal axis 78.

First bottom end panel 96 and first top end panel 94 each include a free edge 114 or 116, respectively. Similarly, second bottom end panel 102 and second top end panel 104 each include a free edge 118 or 120, respectively. Bottom end panels 96 and 102 and top end panels 94 and 104 each include opposing side edge portions 122 and 124 that are each substantially parallel to respective fold lines 44, 46, 52, and/or 54. Although other angles may be used without departing from the scope of the present invention, in one embodiment, side edge portions 122 and 124 are angled at about 180° with respect to respective fold lines 44, 46, 52, and/or 54.

As a result of the above exemplary embodiment of blank 20, a manufacturer's joint, a container bottom wall, and a container top wall formed therefrom may be securely closed so that various products may be securely contained within a formed container. Therefore, less material may be used to fabricate blank 20 having suitable strength for construction of a container that can contain various loads.

As will be described below in more detail with reference to FIGS. 5-42, blank 20 is intended to form a container 200 as shown in FIGS. 2-4 by folding and/or securing panels 22, 24, 26, 28, 30, 32, 34, 36, and/or 38 (shown in FIG. 1) and bottom panels 62, 68, 96, and/or 102 (shown in FIG. 1). Of course, blanks having shapes, sizes, and configurations different than blank 20 described and illustrated herein may be used to form container 200 shown in FIGS. 2-4 without departing from the scope of the present invention. In other words, the machine, processes, and control system described herein can be used to form a variety of different shaped and sized container, and is not limited to blank 20 shown in FIG. 1 and/or container 200 shown in FIGS. 2-4.

FIG. 2 illustrates a perspective view of an exemplary container 200, which is erected and in an open configuration, that may be formed from blank 20 (shown in FIG. 1). FIG. 3 illustrates a perspective view of container 200 in a closed configuration. FIG. 4 illustrates an overhead cross-sectional view of container 200. Referring to FIGS. 1-4, in the exemplary embodiment, container 200 includes a plurality of walls defining a cavity 202. More specifically, container 200 includes a first corner wall 204, a first side wall 206, a second corner wall 208, a first end wall 210, a third corner wall 212, a second side wall 214, a fourth corner wall 216, and a second end wall 218. First corner wall 204 includes first corner panel 22 and glue panel 38, first side wall 206 includes first side panel 24, second corner wall 208 includes second corner panel 26, first end wall 210 includes first end panel 28, third corner wall 212 includes third corner panel 30, second side wall 214 includes second side panel 32, fourth corner wall 216 includes fourth corner panel 34, and second end wall 218 includes second end panel 36, as described in more below. Each wall 204, 206, 208, 210, 212, 214, 216, and 218 has a height 220. Although each wall may have a different height without departing form the scope of the present invention, in the embodiment shown FIGS. 1-4, each wall 204, 206, 208, 210, 212, 214, 216, and 218 has substantially the same height 220.

In the exemplary embodiment, first corner wall 204 connects first side wall 206 to second end wall 218, second corner wall 208 connects first side wall 206 to first end wall 210, third corner wall 212 connects first end wall 210 to second side wall 214, and fourth corner wall 216 connects second side wall 214 to second end wall 218. Further, bottom panels 62, 68, 96, and 102 form a bottom wall 222 of container 200, and top panels 60, 70, 94, and 104 form a top wall 224 of container 200. Although container 200 may have other orientations without departing form the scope of the present invention, in the embodiments shown in FIGS. 2-4, end walls 210 and 218 are substantially parallel to each other, side walls 206 and 214 are substantially parallel to each other, first corner wall 204 and third corner wall 212 are substantially parallel to each other, and second corner wall 208 and fourth corner wall 216 are substantially parallel to each other. Corner walls 204, 208, 212, and 216 are obliquely angled with respect to walls 206, 210, 214, and 218 they interconnect to form angled corners of container 200.

Bottom panels 62, 68, 96, and 102 are each orientated generally perpendicular to walls 204, 206, 208, 210, 212, 214, 216, and 218 to form bottom wall 222. More specifically, bottom end panels 96 and 102 are folded beneath/inside of bottom side panels 62 and 68. Similarly, in a fully closed position (shown in FIG. 3), top panels 60, 70, 94, and 104 are each orientated generally perpendicular to walls 204, 206, 208, 210, 212, 214, 216, and 218 to form top wall 224. Although container 200 may be secured together using any suitable fastener at any suitable location on container 200 without departing from the scope of the present invention, in one embodiment, adhesive (not shown) is applied to an inner surface and/or an outer surface of first corner panel 22 and/or glue panel 38 to form first corner wall 204. In one embodiment, adhesive may also be applied to exterior surfaces of bottom end panels 96 and/or 102 and/or interior surfaces of bottom side panels 62 and/or 68 to secure bottom side panels 62 and/or 68 to bottom end panels 96 and/or 102. As a result of the above exemplary embodiment of container 200, the manufacturer's joint, bottom wall 222, and/or top wall 224 may be securely closed so that various products may be securely contained within container 200. Therefore, less material may be used to fabricate a stronger container 200.

Figure 5:
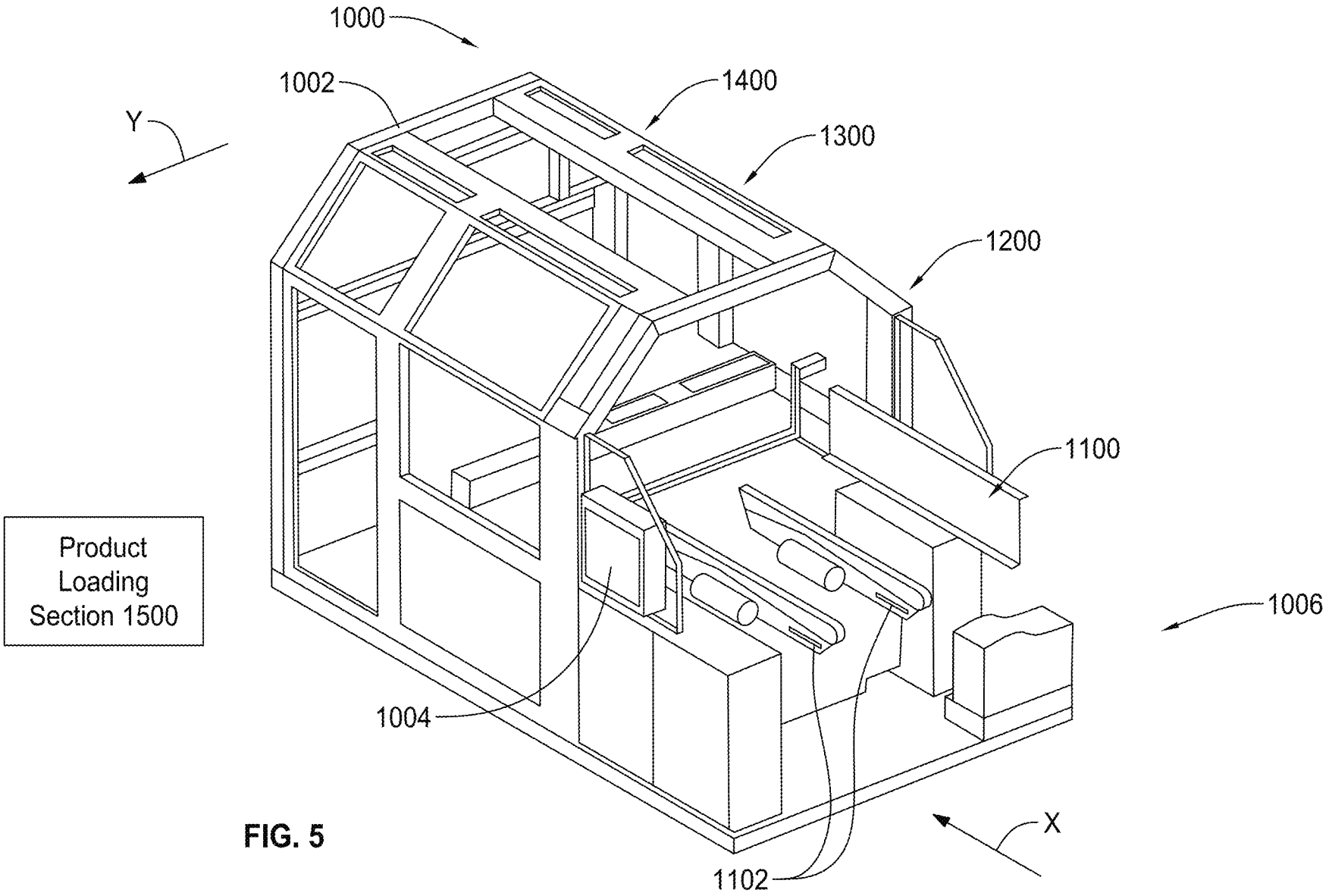
FIG. 5 is a perspective view of an exemplary embodiment of a machine that may be used to form a container from the blank of sheet material shown in FIG. 1.
Figure 6:
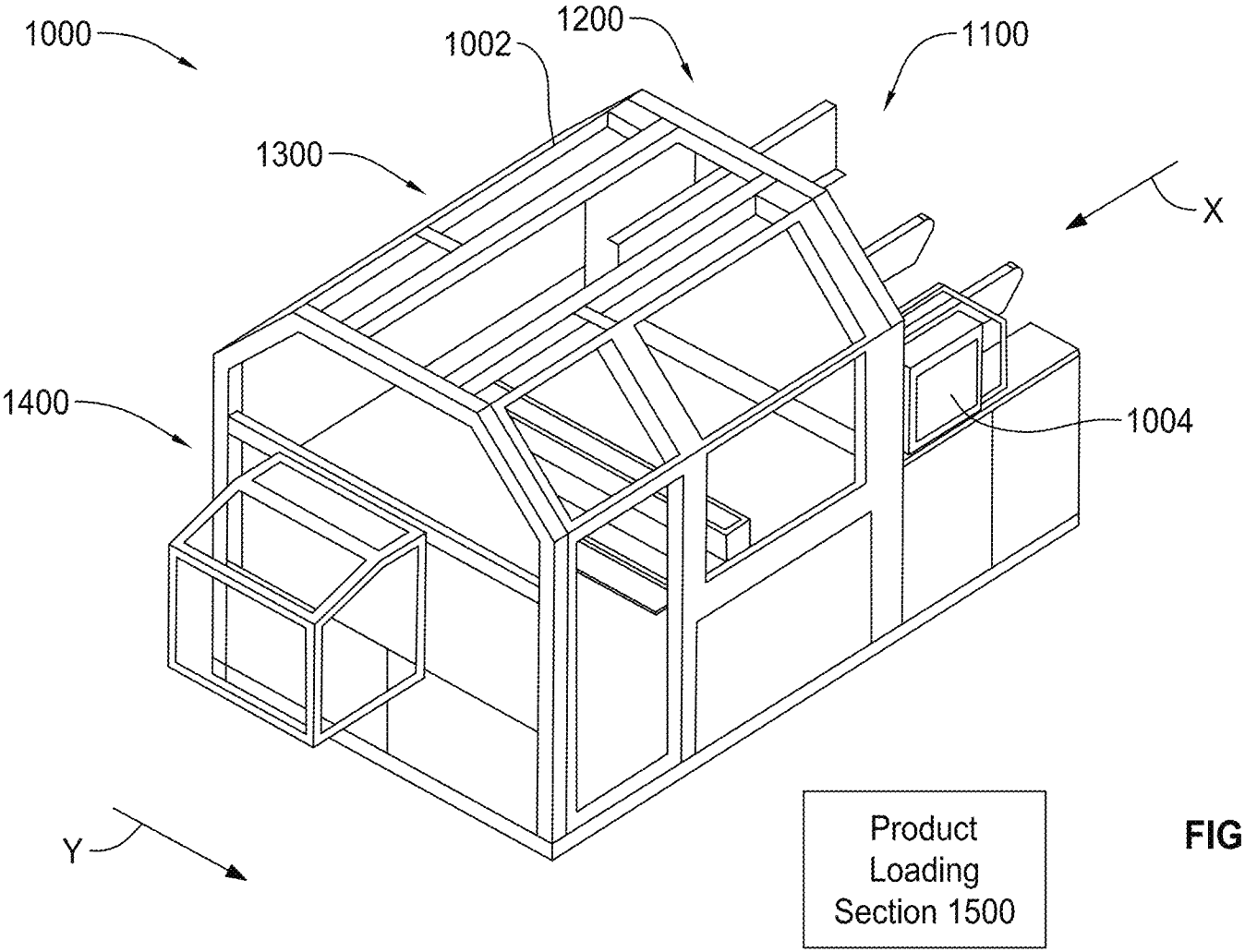
FIG. 6 is another perspective view of the machine shown in FIG. 5.

FIG. 5 illustrates a perspective view of an exemplary machine 1000 for forming a container, such as container 200 (shown in FIGS. 2-4) from a blank of sheet material, such as blank 20 (shown in FIG. 1). FIG. 6 illustrates another perspective view of machine 1000. Machine 1000 will be discussed thereafter with reference to forming corrugated container 200 from blank 20; however, machine 1000 may be used to form a box or any other container having any size, shape, and/or configuration from a blank having any size, shape, and/or configuration without departing from the scope of the present invention.

As shown in FIGS. 5 and 6, machine 1000 includes a magazine feed section 1100, a vacuum transfer section 1200, a mandrel wrap section 1300, an outfeed section 1400, and a product load section 1500 positioned with respect to and/or coupled to a frame 1002. A control system 1004 is coupled in operative control communication with components of machine 1000, as described in more detail herein. Magazine feed section 1100 is positioned at an upstream end 1006 of machine 1000 with respect to a sheet loading direction indicated by an arrow X. Vacuum transfer section 1200 in positioned downstream from magazine feed section 1100 in sheet loading direction X. Moreover, mandrel wrap section 1300 is positioned downstream from vacuum transfer section 1200 in sheet loading direction X. Further, outfeed section 1400 is positioned downstream from mandrel wrap section 1300 in sheet loading direction X, and product load section 1500 is positioned downstream from outfeed section 1400 with respect to a container discharge direction indicated by an arrow Y. Product load section 1500 is where a product is loaded into formed container 200, and container 200 is closed and sealed for shipping and/or storing the product.

FIGS. 7-15 illustrate various portions and perspectives of magazine feed section 1100 and vacuum transfer section 1200 of machine 1000. In the exemplary embodiment, magazine feed section 1100 includes a plurality of powered magazine drives 1102 for receiving a plurality of blanks 20. Blanks 20 are orientated in any manner that enables operation of machine 1000 as described herein. In the example embodiment, blanks 20 are loaded vertically into magazine feed section 1100. Magazine feed section 1100 may also include an alignment device (not shown) such as, but not limited to, a stack presser and/or any other device that justifies and/or aligns blanks 20. After blanks 20 are loaded onto magazine drives 1102, a bundle of blanks 20 is conveyed, in sheet loading direction X, from magazine feed section 1100 to vacuum transfer section 1200.

Figure 7:
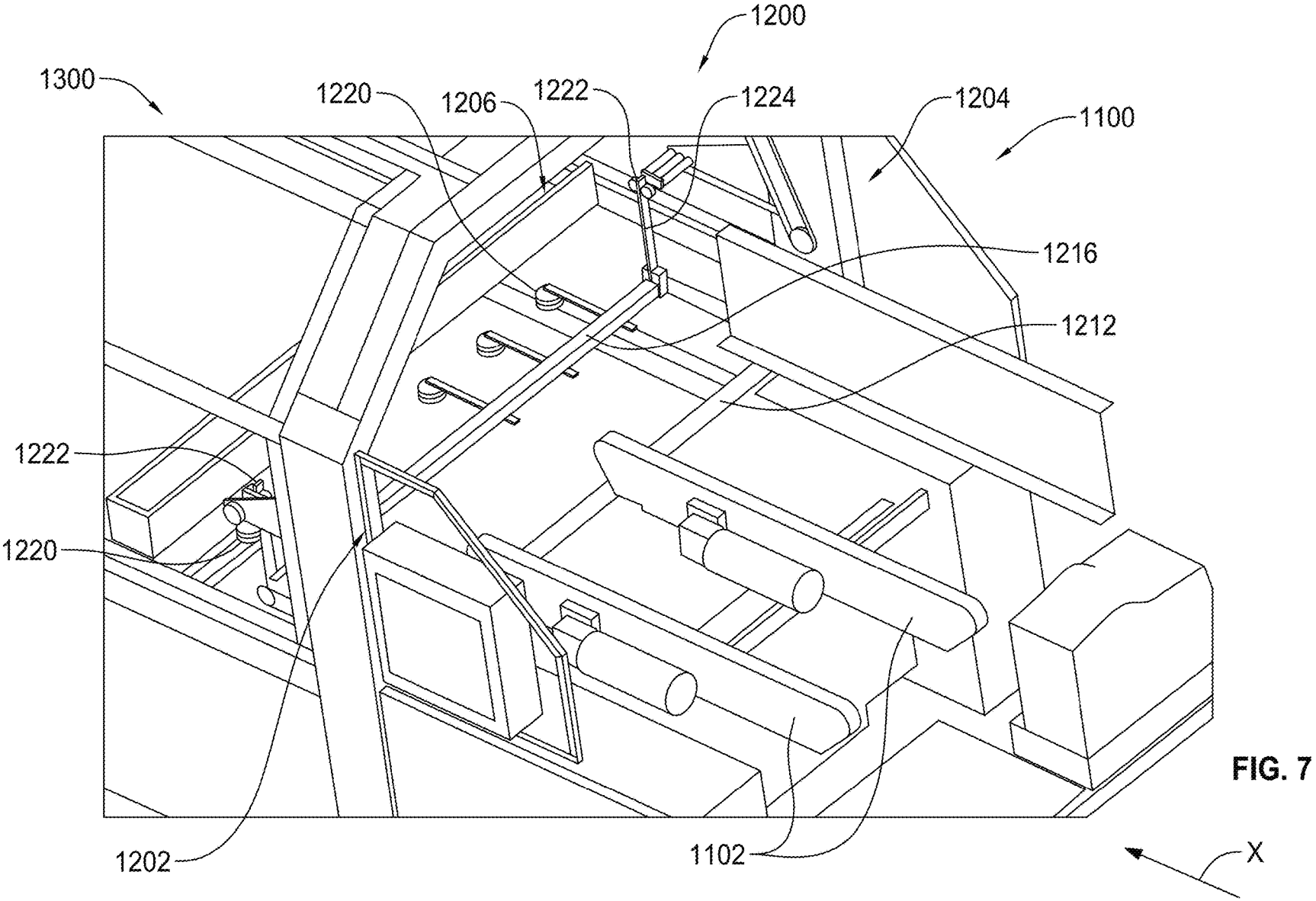
FIG. 7 is a perspective view of an exemplary magazine feed section and an exemplary vacuum transfer section included within the machine shown in FIGS. 5 and 6.
Figure 8:
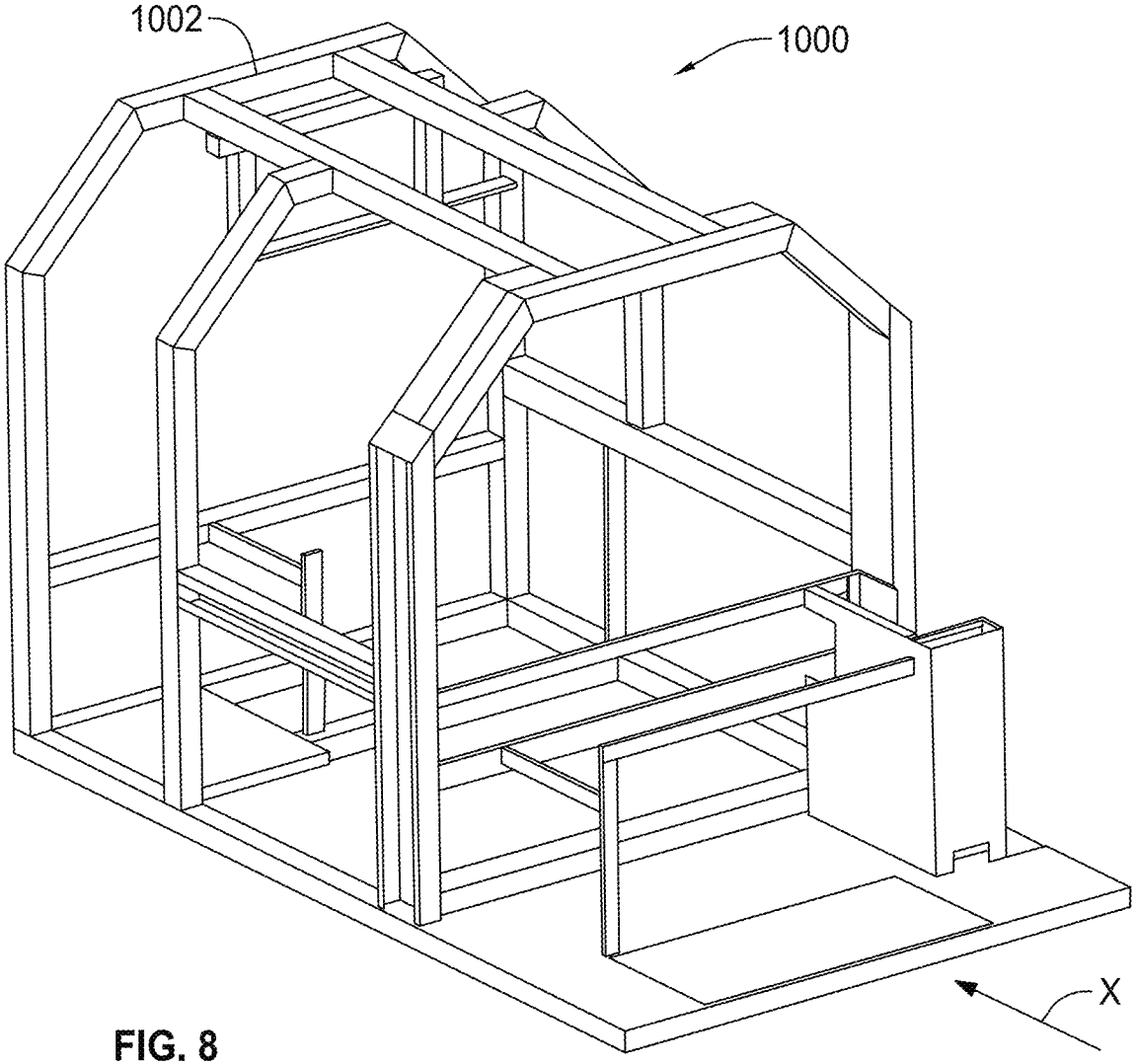
FIG. 8 is a perspective view of a portion of the vacuum transfer section shown in FIG. 7.
Figure 9:
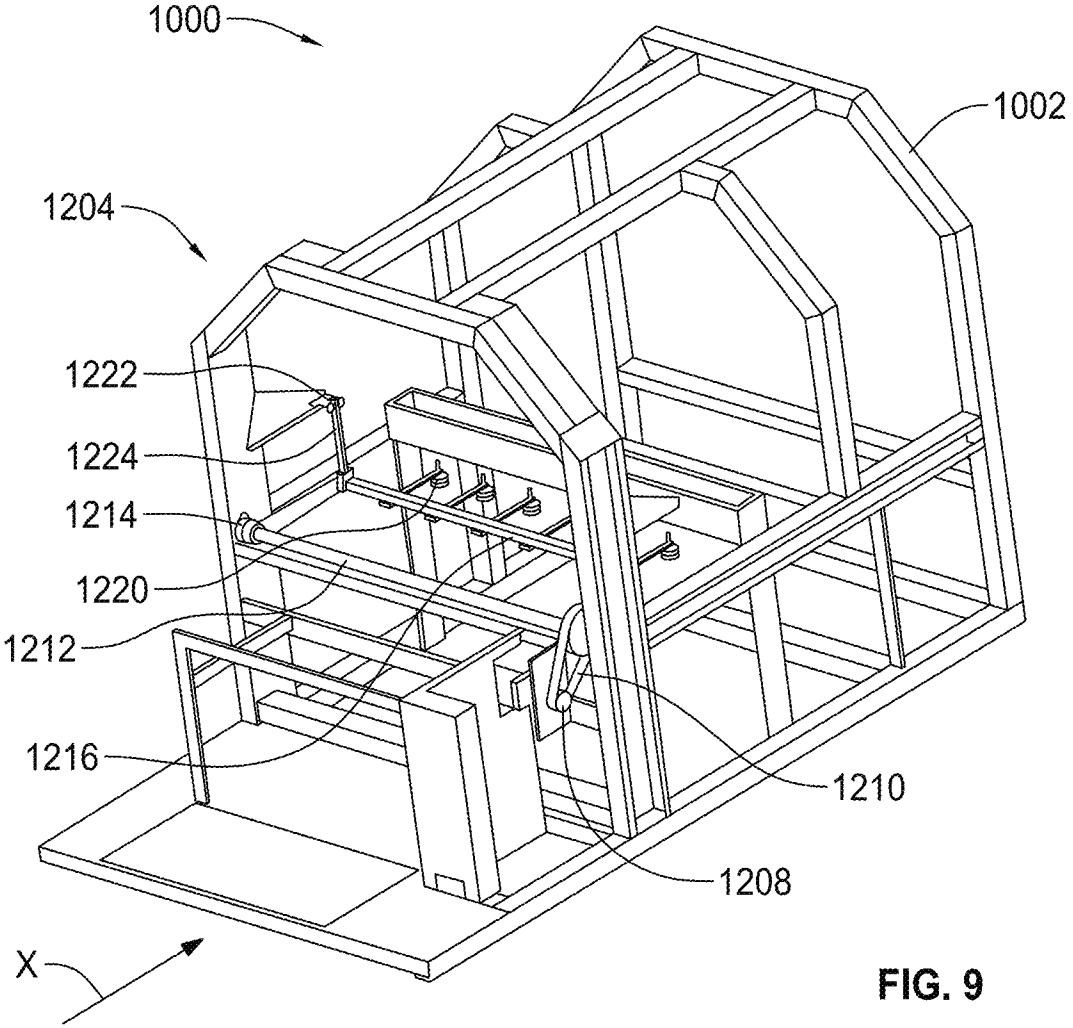
FIG. 9 is a perspective view of a portion of the vacuum transfer section shown in FIG. 7.
Figure 10:
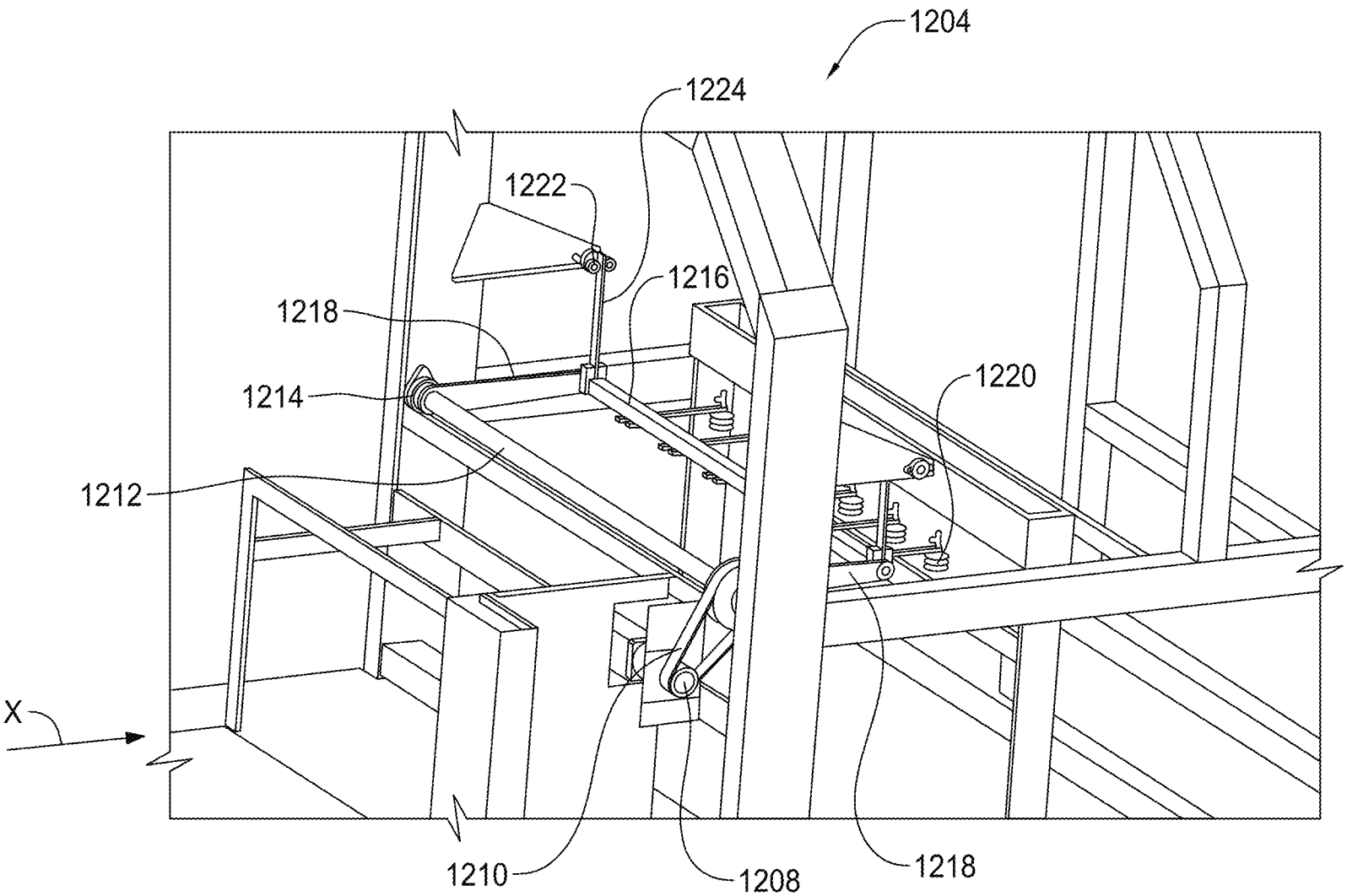
FIG. 10 is a perspective view of a portion of the vacuum transfer section shown in FIG. 7.
Figure 11:
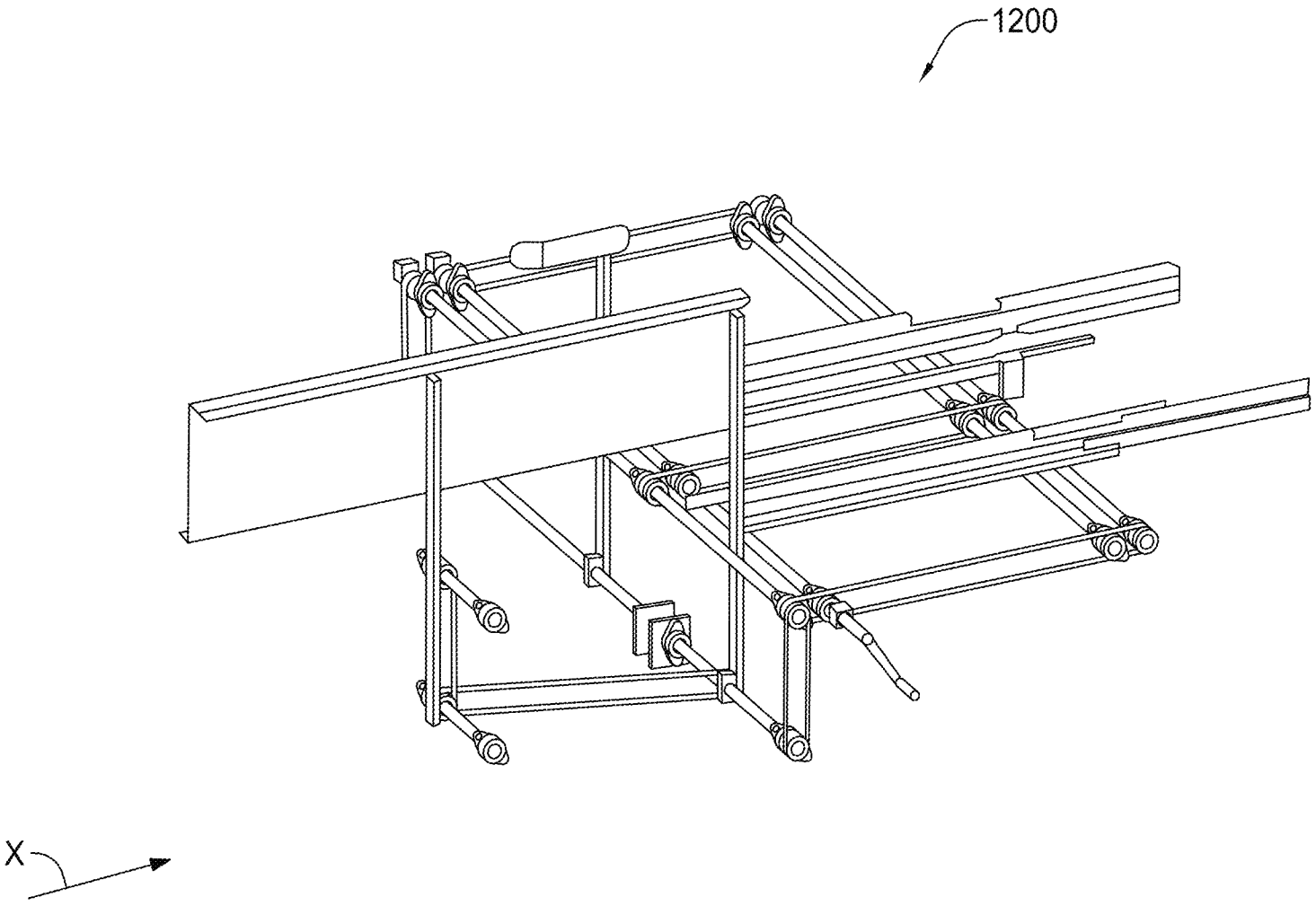
FIG. 11 is a perspective view of a portion of the vacuum transfer section including a rail transfer mechanism as shown in FIG. 7.

As shown in FIGS. 7, 9, and 10, vacuum transfer section 1200 includes a transfer assembly 1202 having a pick-up assembly 1204 and a pusher assembly 1206. Pick-up assembly 1204 includes a servomechanism 1208 operatively coupled to a drive shaft belt 1210 that is, in turn, operatively coupled to a drive shaft 1212. Drive shaft 1212 is supported and aligned by at least one bearing 1214. Pick-up assembly 1204 further includes a pivoting pick-up bar 1216 that is operatively coupled to drive shaft 1212 via a plurality of pick-up arm drive belts 1218. A plurality of vacuum suction cups 1220 are fixedly coupled to pick-up bar 1216, and a plurality of rollers 1222 are coupled to each of pick-up arms 1224 that are coupled to pick-up bar. Suction cups 1220 include independent vacuum generators (not shown) for providing suction to attach suction cups 1220 to individual blanks 20. In an alternative embodiment, suction cups 1220 are attached to a centralized vacuum generator, which provides the vacuum for suction cups 1220 to attach to a blank 20.

In operation, servomechanism 1208 is commanded, instructed, and/or controlled to position suction cups 1220 to facilitate picking up a blank 20 from magazine feed section 1100 and feeding blank 20 through vacuum transfer section 1200 toward mandrel wrap section 1300. Servomechanism 1208 bi-directionally positions drive shaft belt 1210, which in turn bi-directionally rotates drive shaft 1212. The bi-directional rotation of drive shaft 1212 induces bi-directional rotation of pick-up arm drive belts 1210, which in turn induces bi-directional rotation of pick-up arms 1224 and pick-up bar 1216. The general motion of pick-up arms 1224 and pick-up bar 1216 is a rotation in clockwise and counter-clockwise directions through an arc while also moving up and down. Suction cups 1220 follow the general motion of pick-up bar 1216. Suction cups 1220 release blank 20 into pusher assembly 1206 and pick-up servomechanism 1208 reverses direction to reverse the movement of suction cups 1220 to their original position to pick-up the next blank 20. In the exemplary embodiment, pick-up servomechanism 1208 can hold pick-up bar 1216 in a neutral position until a previous blank 20 has been ejected from mandrel wrap section 1300, as described in more detail herein.

Figure 14:
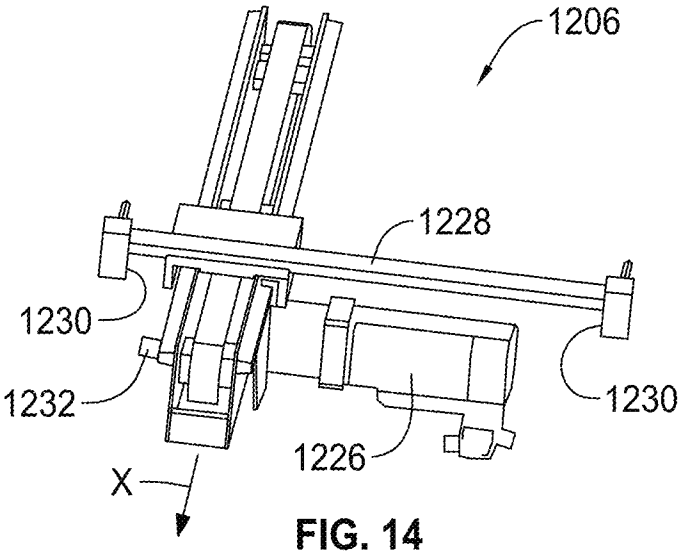
FIG. 14 is a perspective view of an exemplary pusher assembly including a servo mechanism that is part of the vacuum transfer section shown in FIG. 7.
Figure 13:
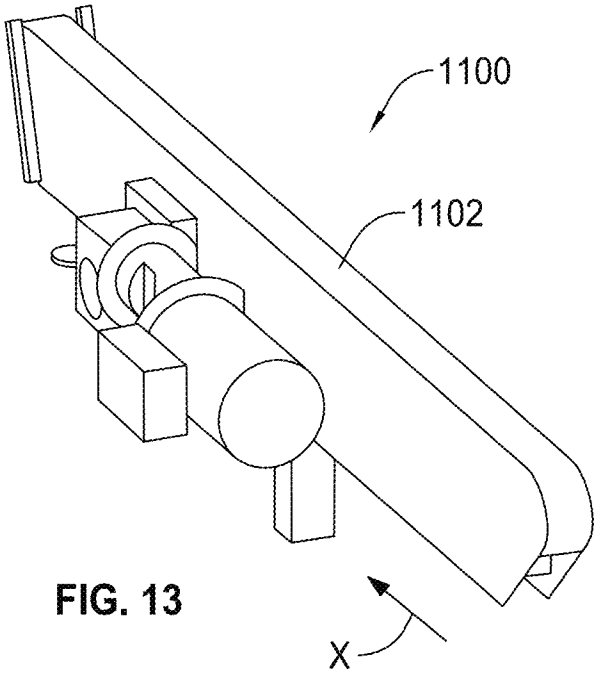
FIG. 13 is a perspective view of a magazine drive from the magazine feed assembly which is part of the vacuum transfer section shown in FIG. 7.
Figure 15:
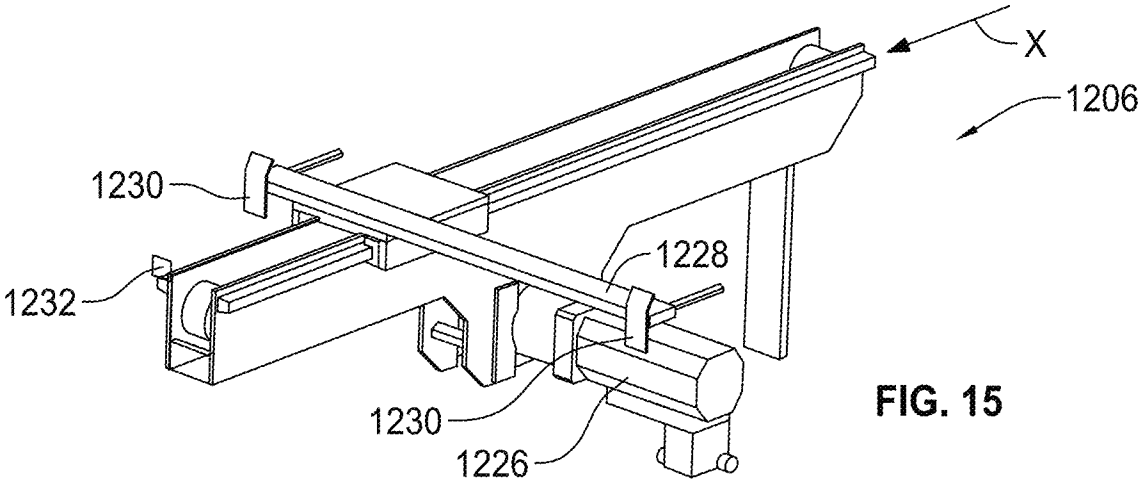
FIG. 15 is another perspective view of the pusher assembly shown in FIG. 14.
Figure 16:
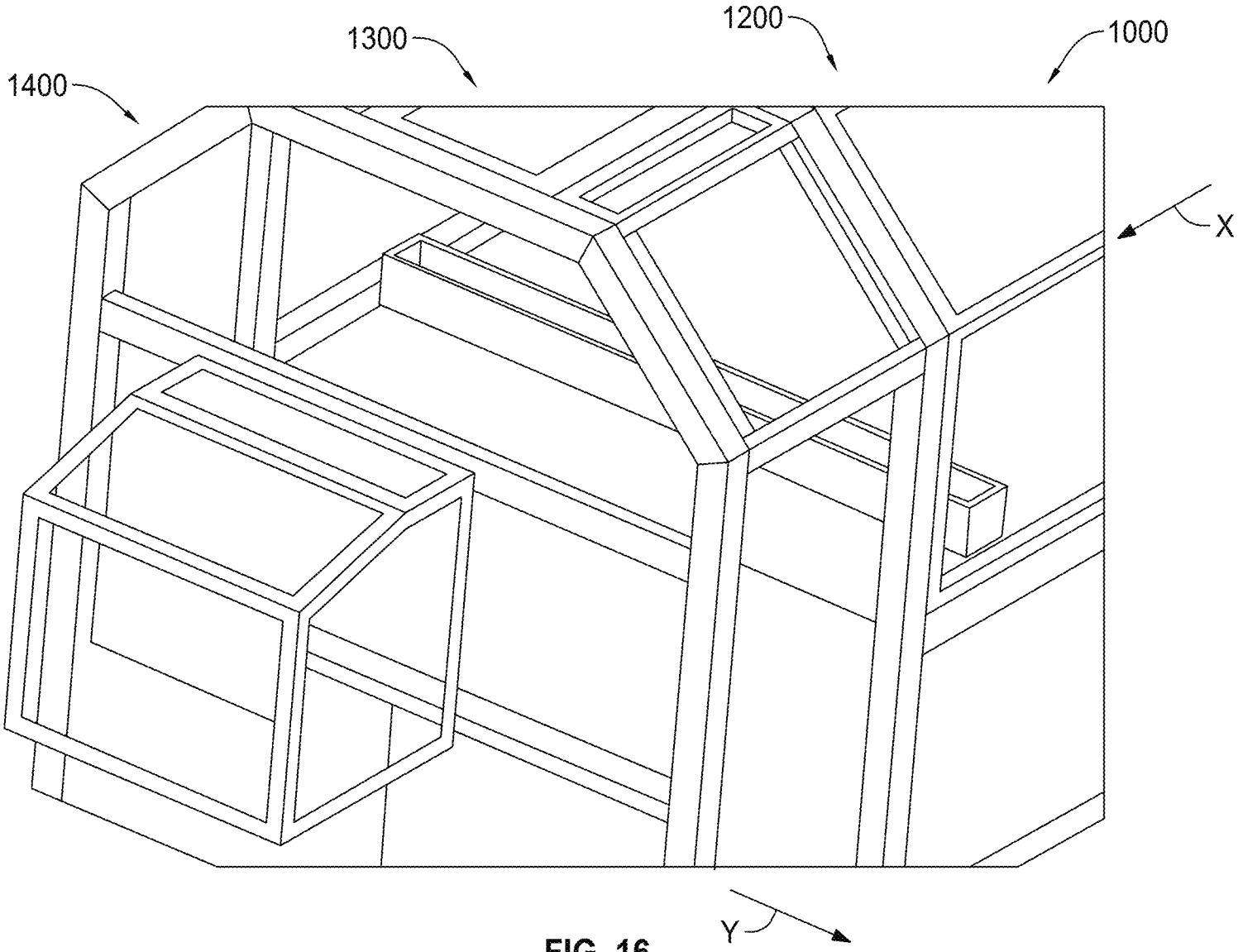
FIG. 16 is a perspective view of an exemplary mandrel wrap section that is part of the machine shown in FIGS. 5 and 6.
Figure 17:
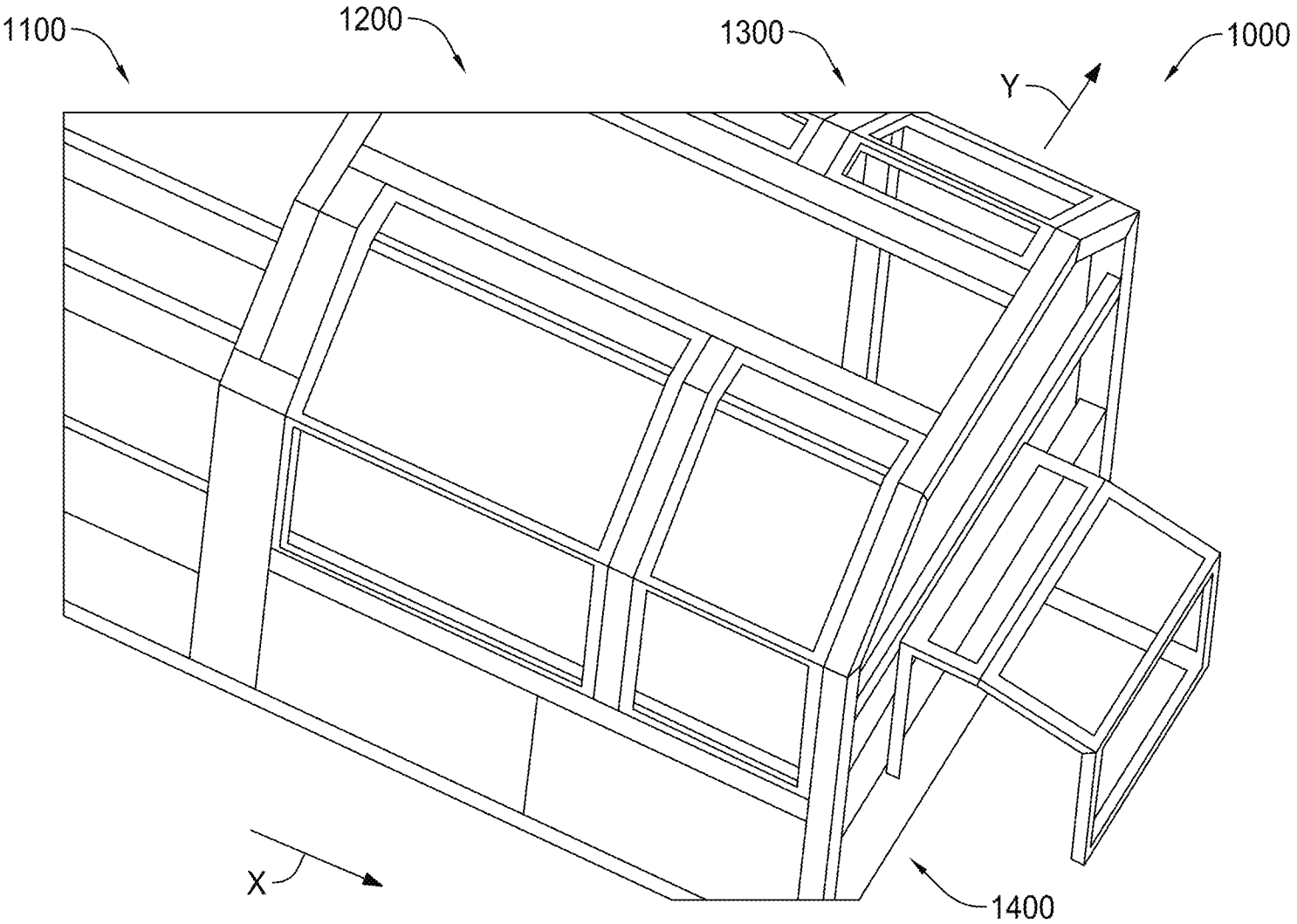
FIG. 17 is another perspective view of the mandrel wrap section shown in FIG. 16.
Figure 18:
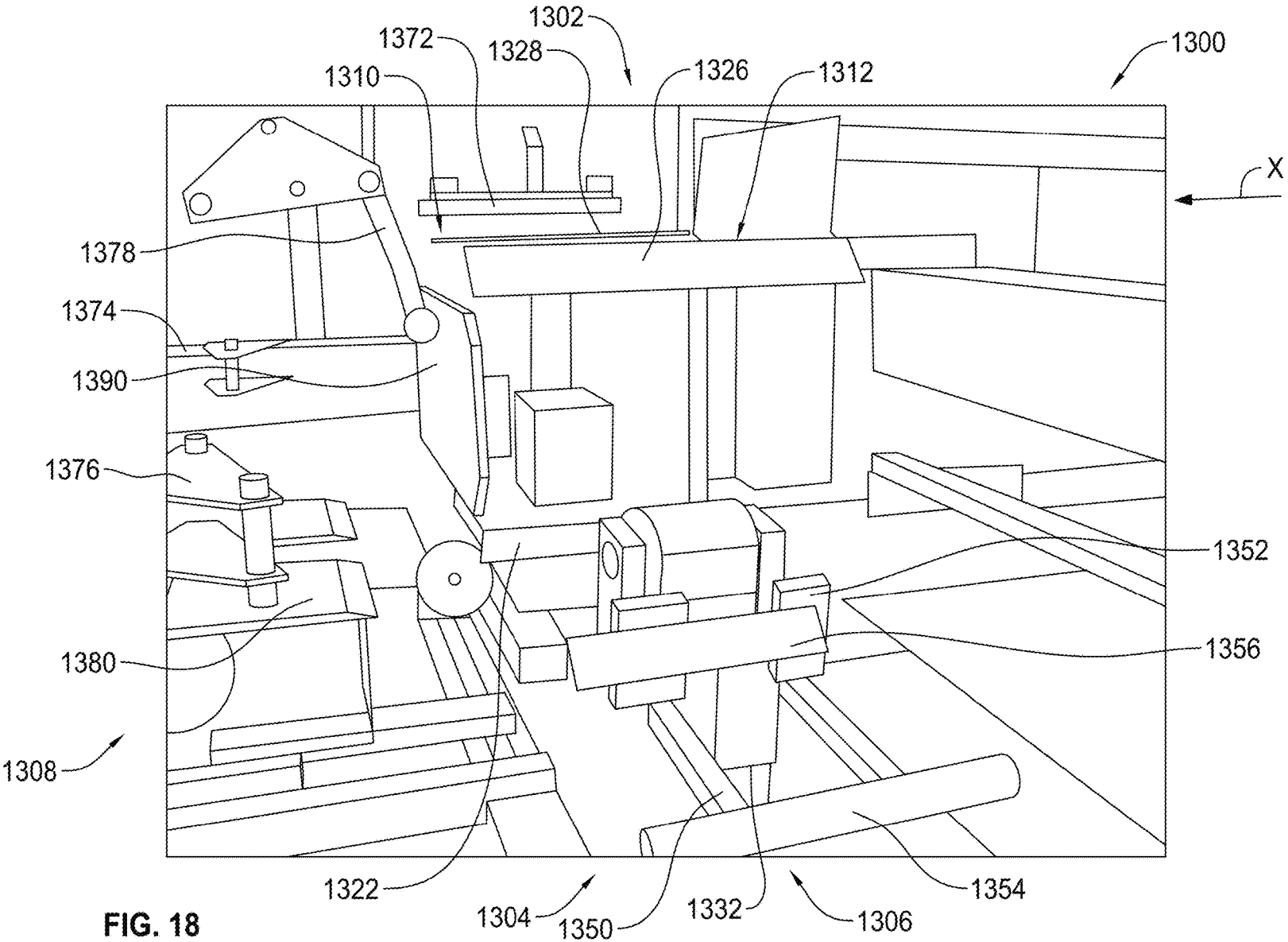
FIG. 18 is a perspective view of an exemplary mandrel assembly that may be used with the mandrel wrap section shown in FIGS. 16 and 17.
Figure 19:
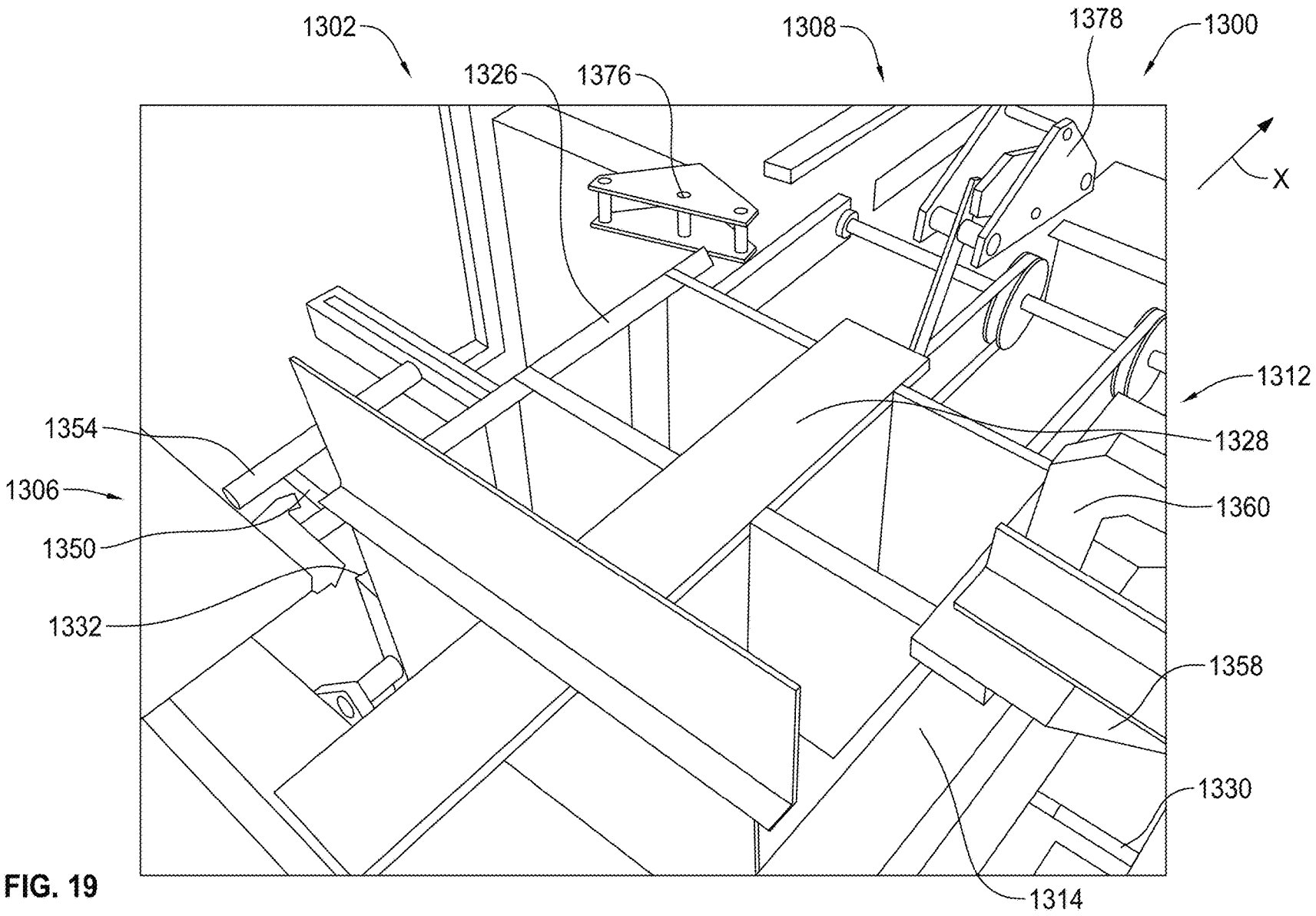
FIG. 19 is another perspective view of the mandrel assembly shown in FIG. 18.
Figure 20:
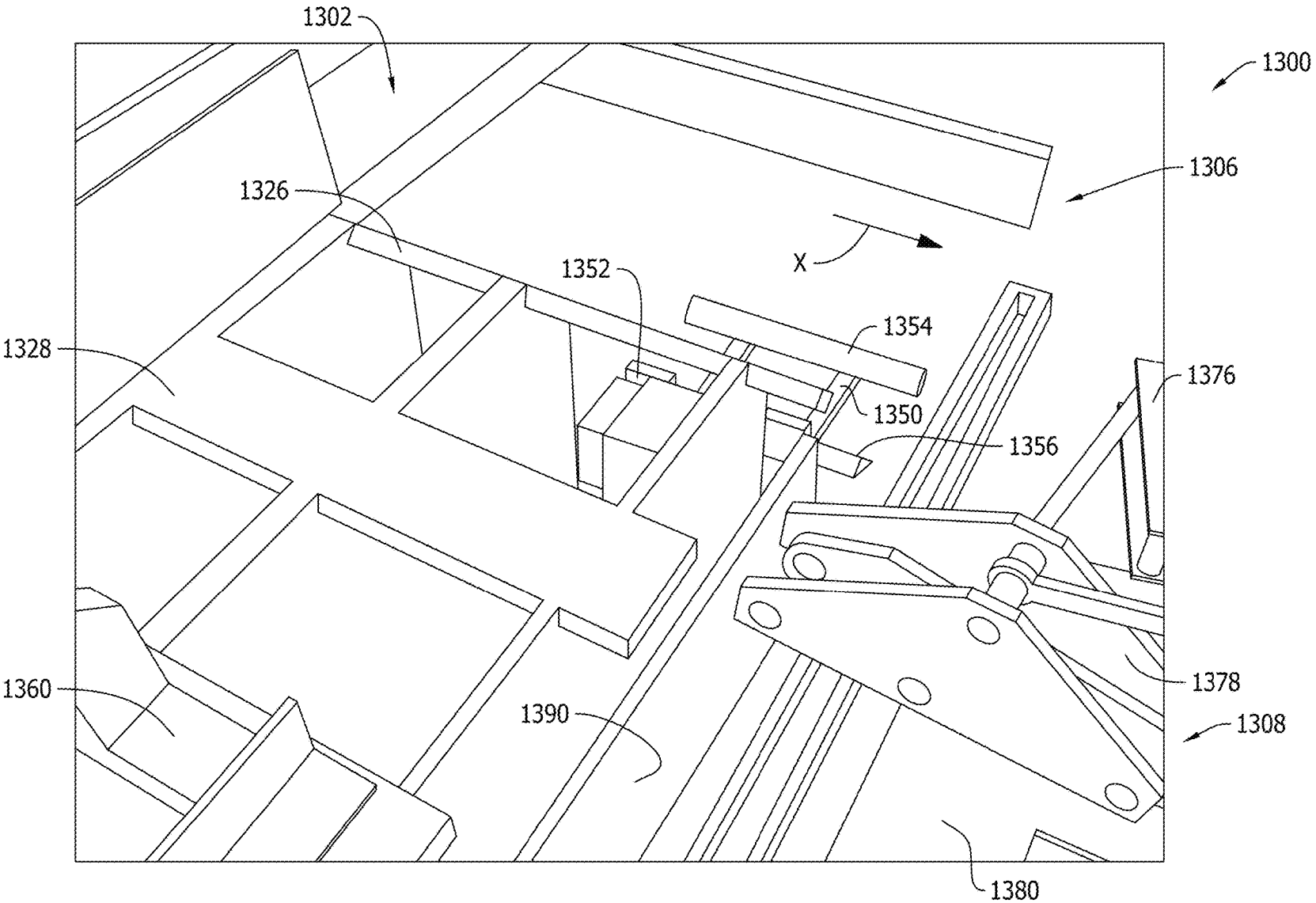
FIG. 20 is another perspective view of the mandrel assembly shown in FIG. 18.
Figure 21:
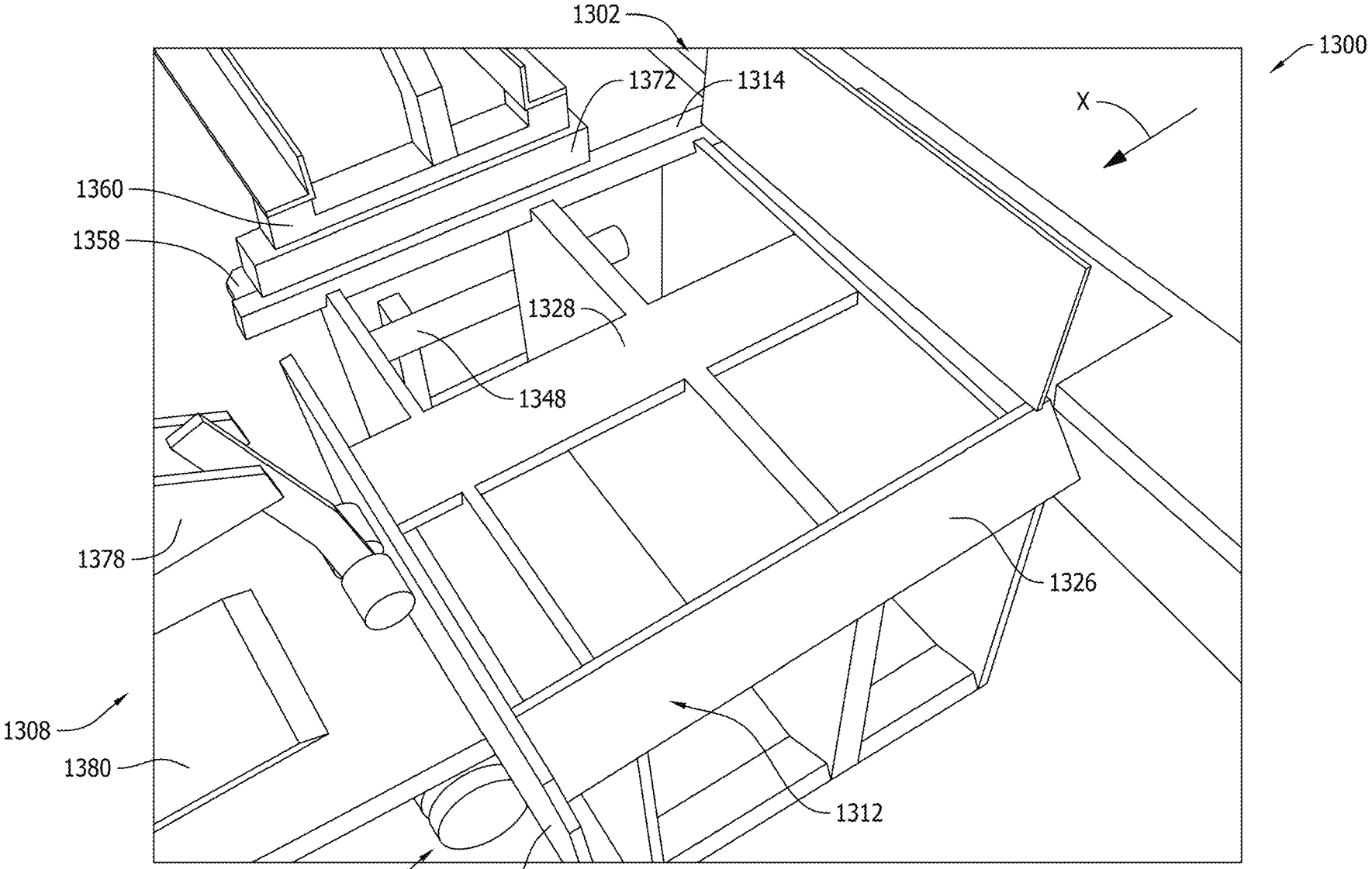
FIG. 21 is another perspective view of the mandrel assembly shown in FIG. 18.
Figure 22:
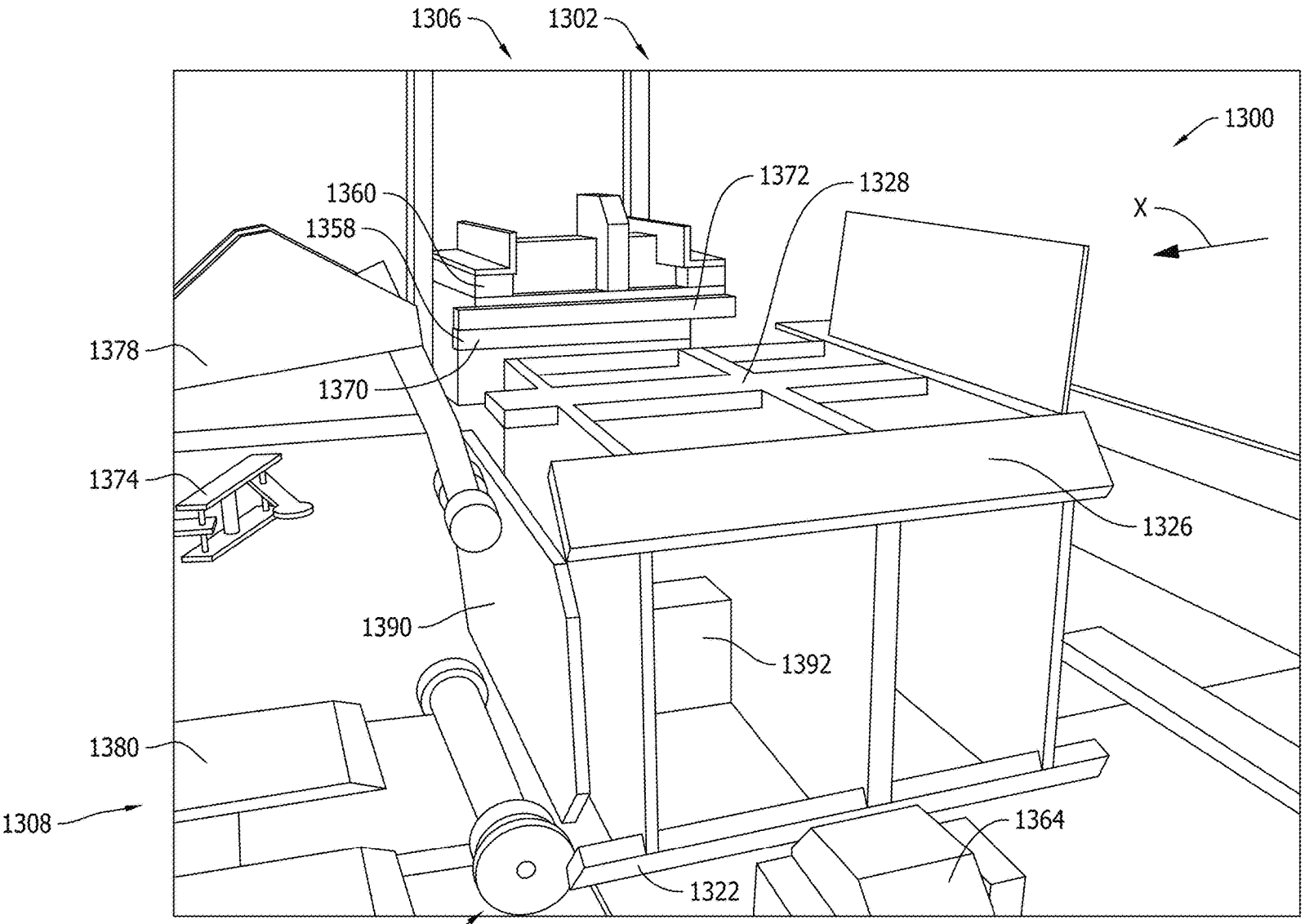
FIG. 22 is another perspective view of the mandrel assembly shown in FIG. 18.
Figure 23:
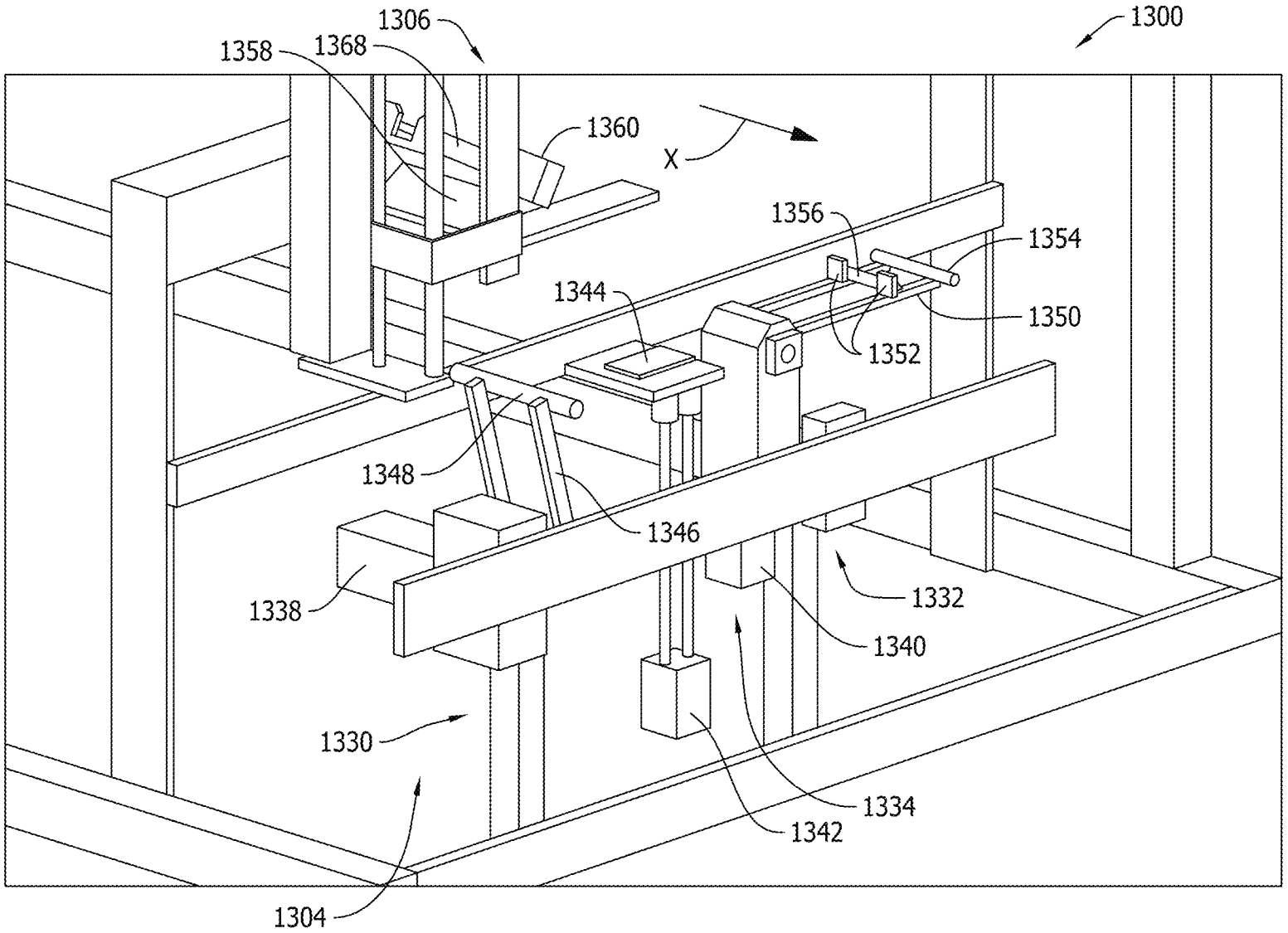
FIG. 23 is a perspective view of a portion of an exemplary lift frame assembly that is part of the machine shown in FIGS. 5 and 6.
Figure 24:
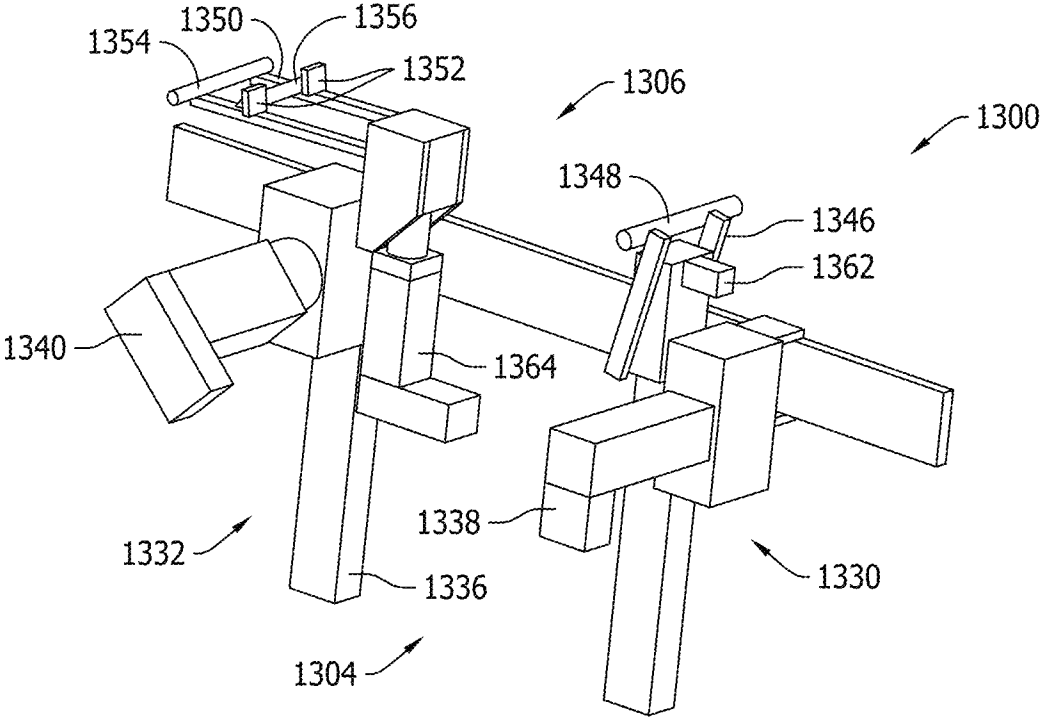
FIG. 24 is another perspective view of the portion of the lift frame assembly shown in FIG. 23.
Figure 25:
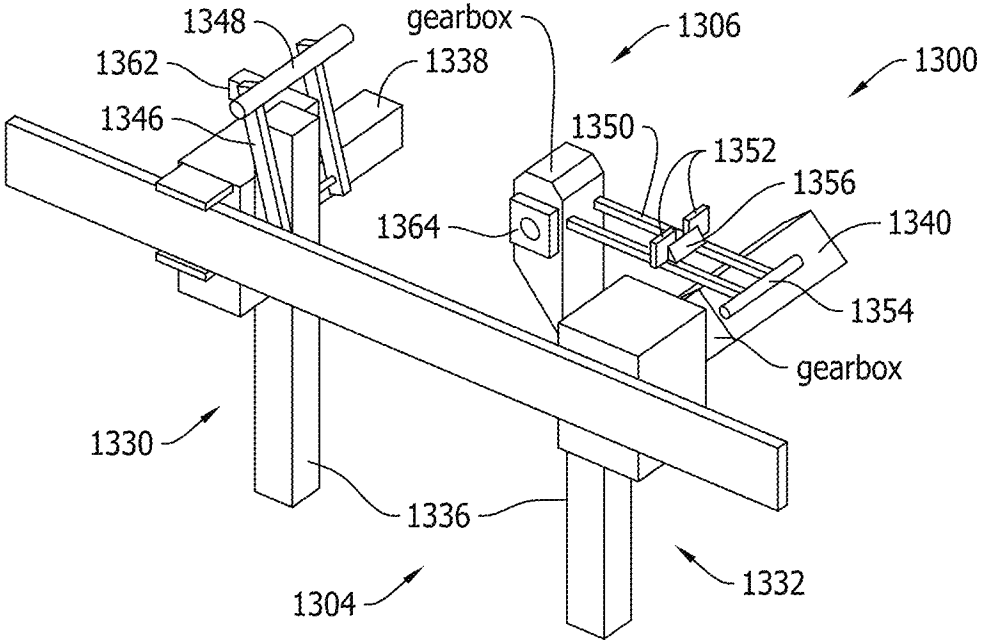
FIG. 25 is another perspective view of the portion of the lift frame assembly shown in FIG. 23.
Figure 26:
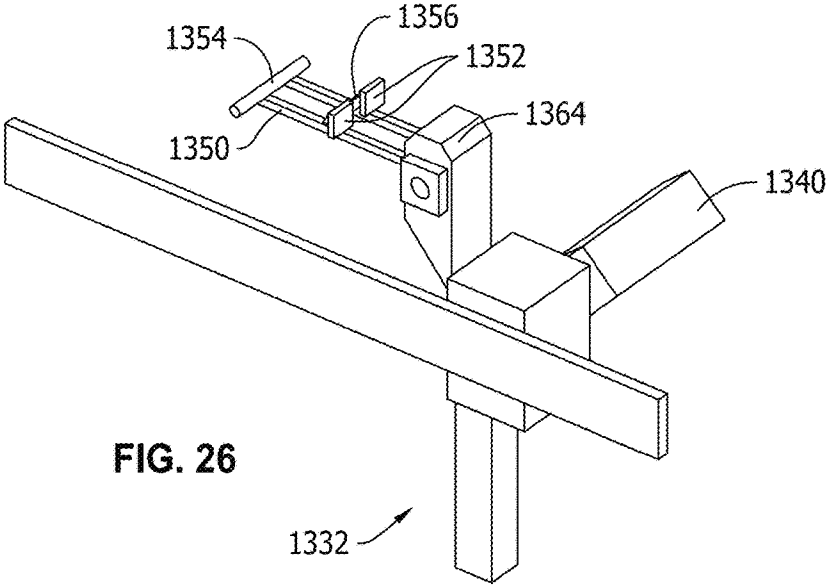
FIG. 26 is another perspective view of a portion of the lift frame assembly on the side where the folding arm is mounted as shown in FIG. 23.
Figure 27:
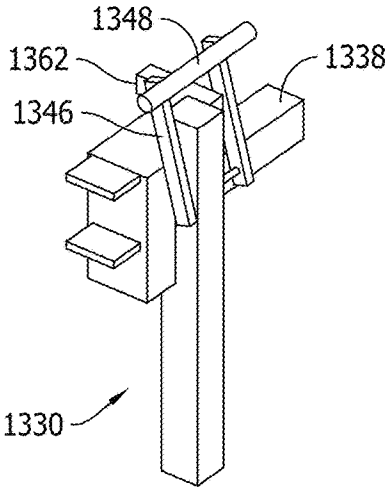
FIG. 27 is a perspective view of a portion of the lift frame assembly with the lateral presser arm as shown in FIG. 23.
Figure 28:
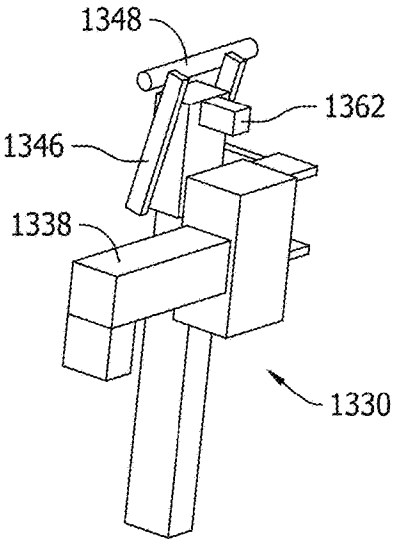
FIG. 28 is another perspective view of a portion of the lift frame assembly with the lateral presser arm as shown in FIG. 23.
Figure 29:
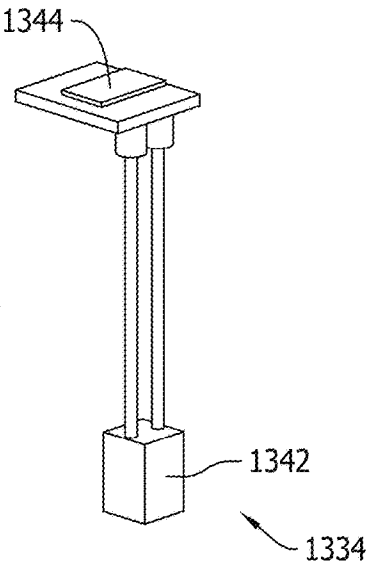
FIG. 29 is a perspective view of a portion of an under plate section used to capture the blank under the mandrel wrap section shown in FIGS. 16 and 17.
Figure 30:
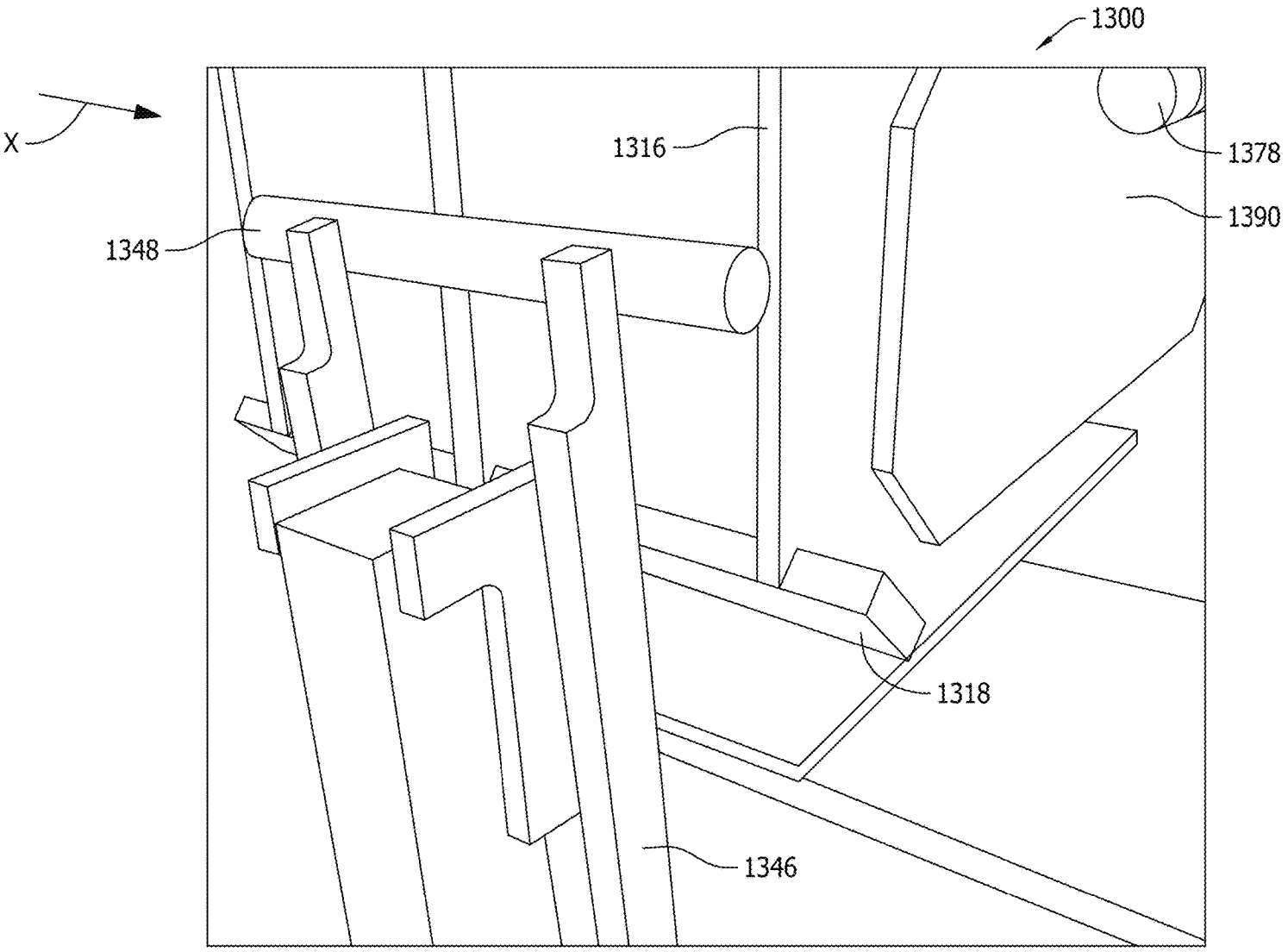
FIG. 30 is a perspective view of an exemplary lateral presser arm that is part of the machine shown in FIG. 5.
Figure 31:
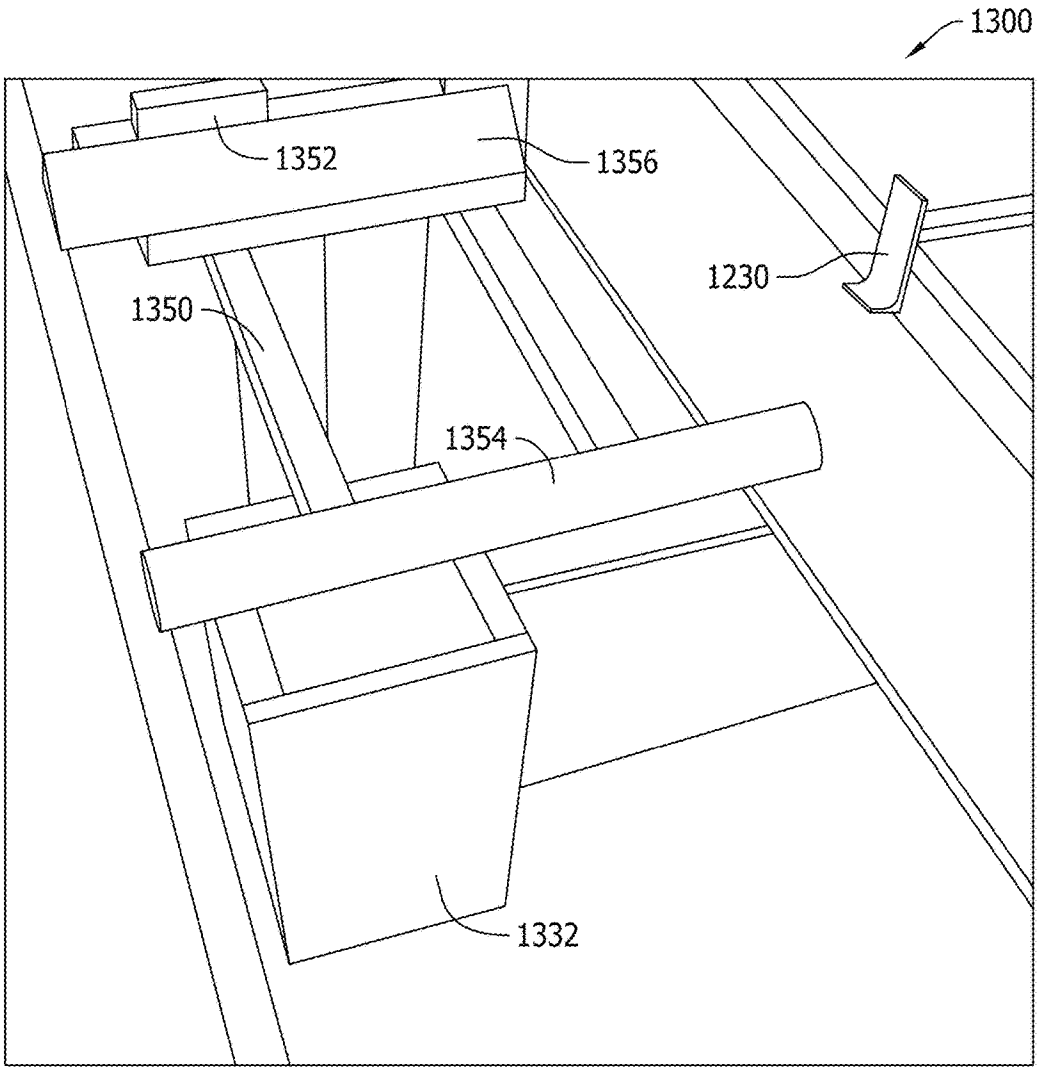
FIG. 31 is a perspective view of an exemplary folding arm that is part of the machine shown in FIG. 5.
Figure 32:
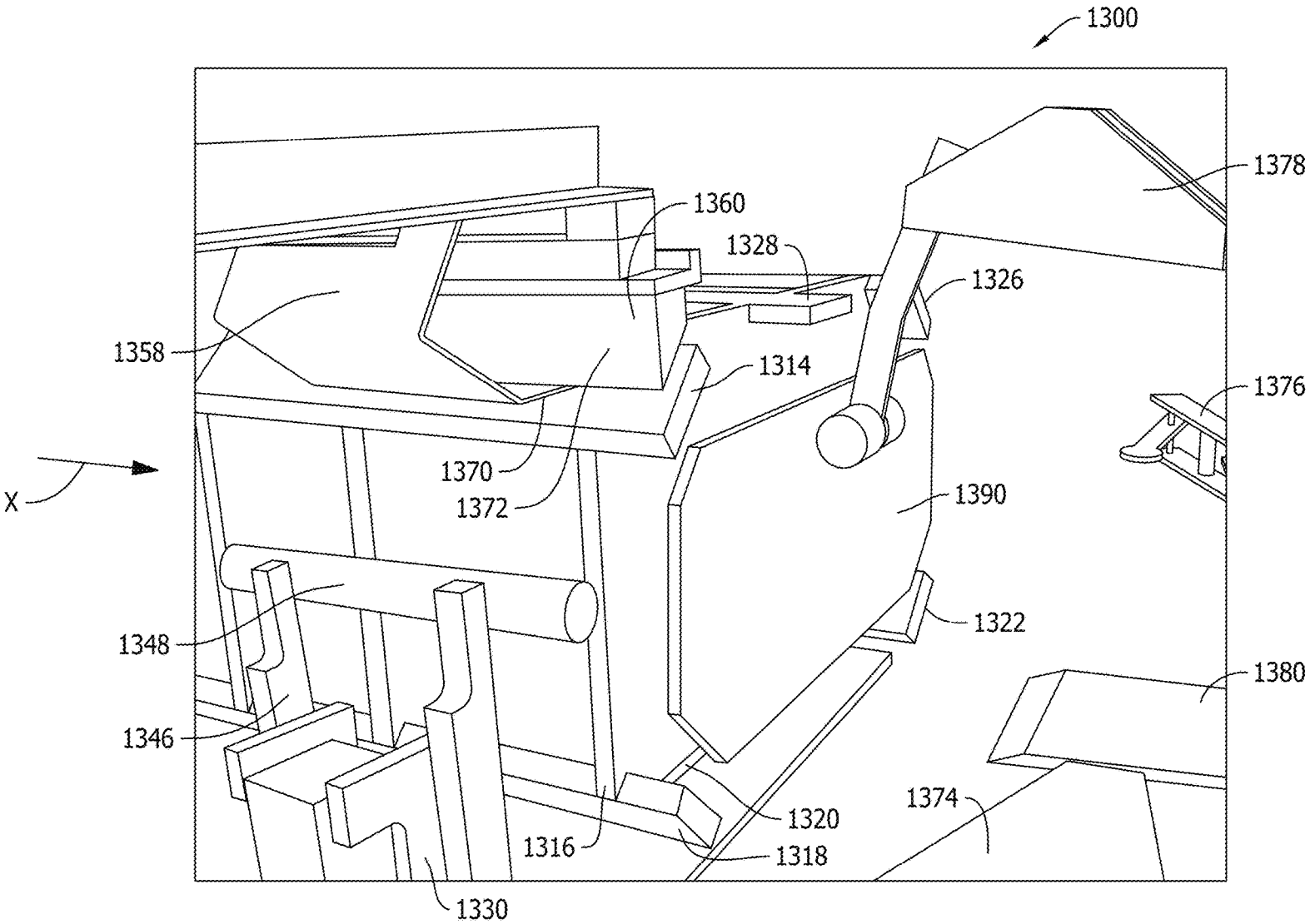
FIG. 32 is a perspective view of an exemplary lateral presser arm, glue tab presser, and glue tab folder that is part of the machine shown in FIG. 5.
Figure 33:
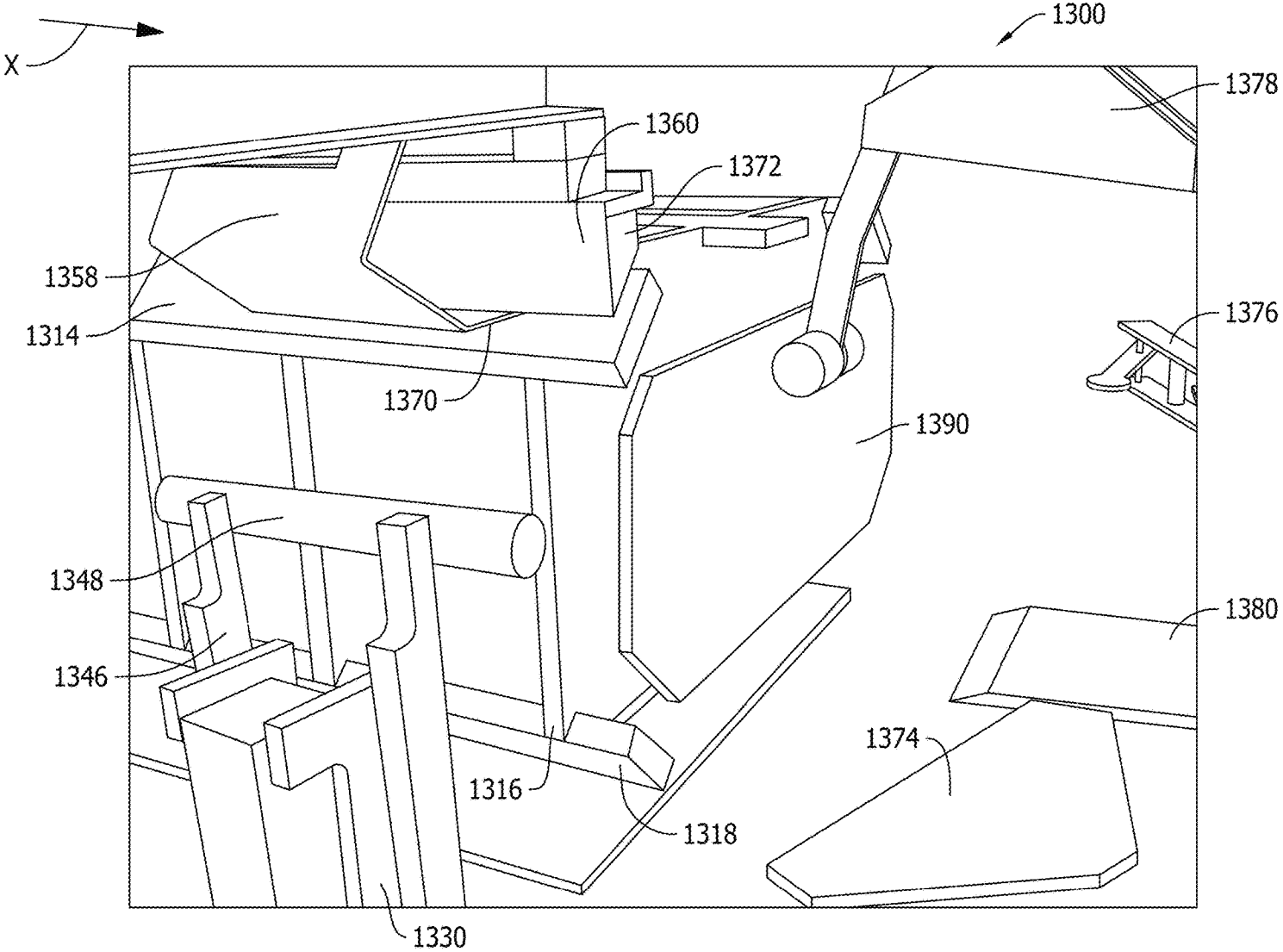
FIG. 33 is another perspective view of an exemplary lateral presser arm, glue tab presser, and glue tab folder that is part of the machine shown in FIG. 5.
Figure 34:
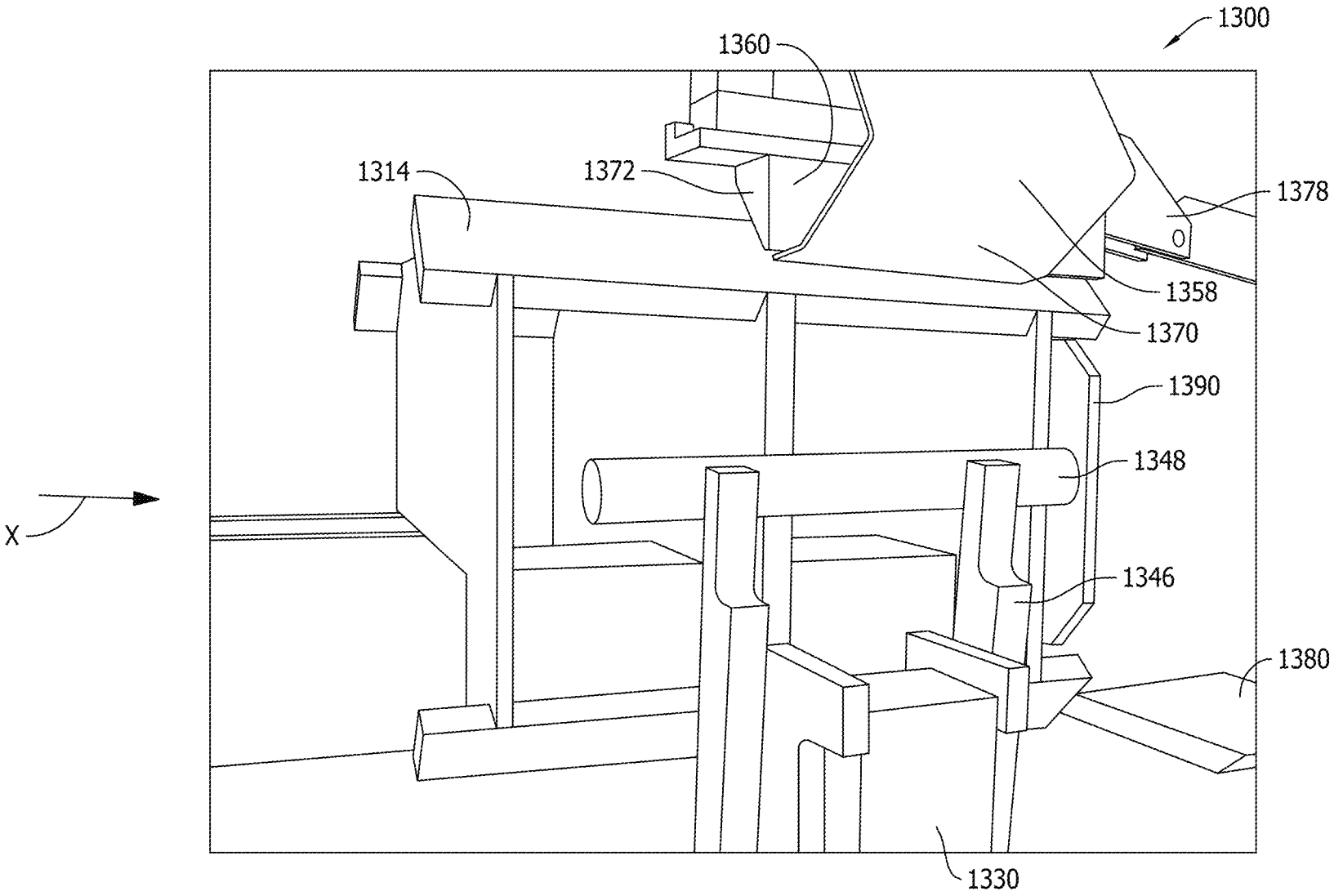
FIG. 34 is another perspective view of an exemplary lateral presser arm that is part of the lift frame assembly shown in FIG. 23.
Figure 35:
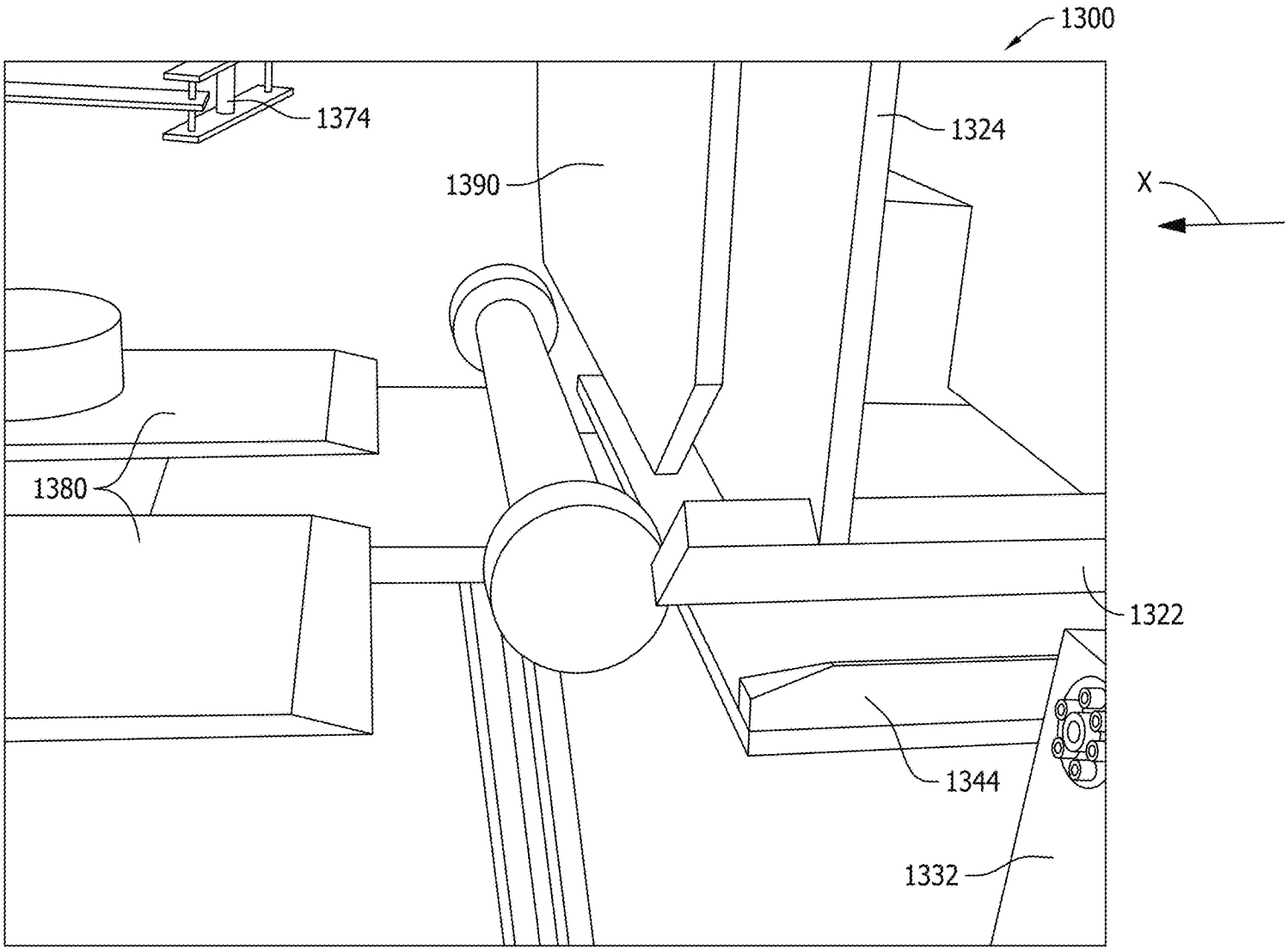
FIG. 35 is a perspective view of an exemplary outfeed assembly that may be used with the machine shown in FIGS. 5 and 6.
Figures 36, 37:
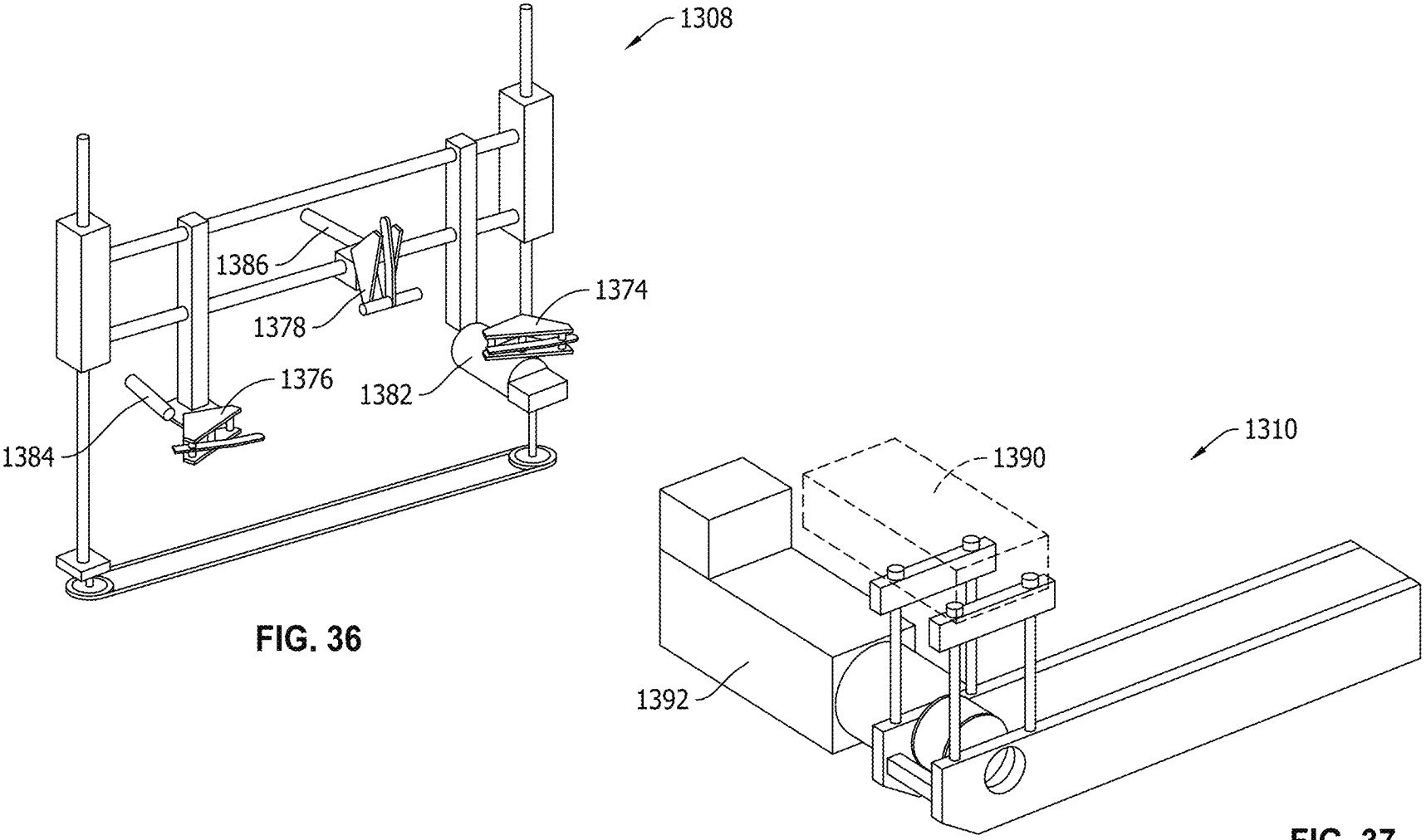
FIG. 36 is a perspective view of a portion of the outfeed assembly shown in FIG. 35.
FIG. 37 is a perspective view of a servo-driven eject assembly included within the machine shown in FIG. 5.
Figure 39:
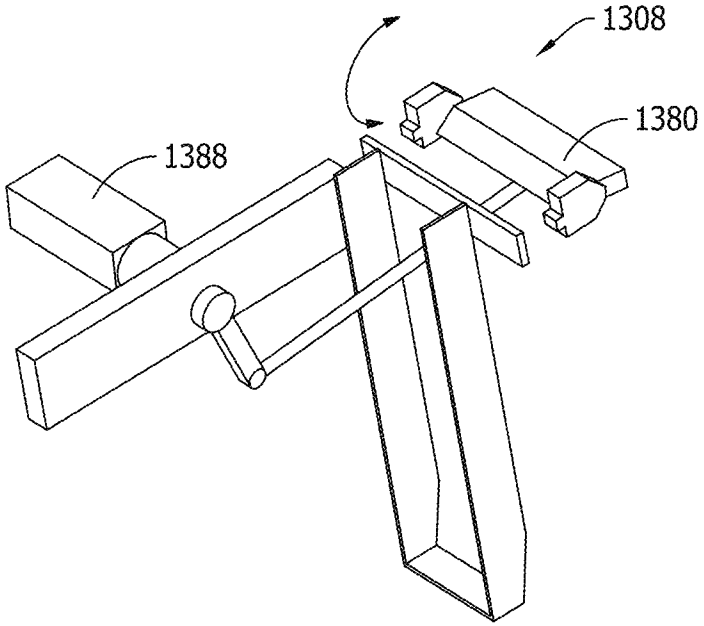
FIG. 39 is a perspective view of a bottom presser plate assembly included within the machine shown in FIG. 5.
Figure 38:
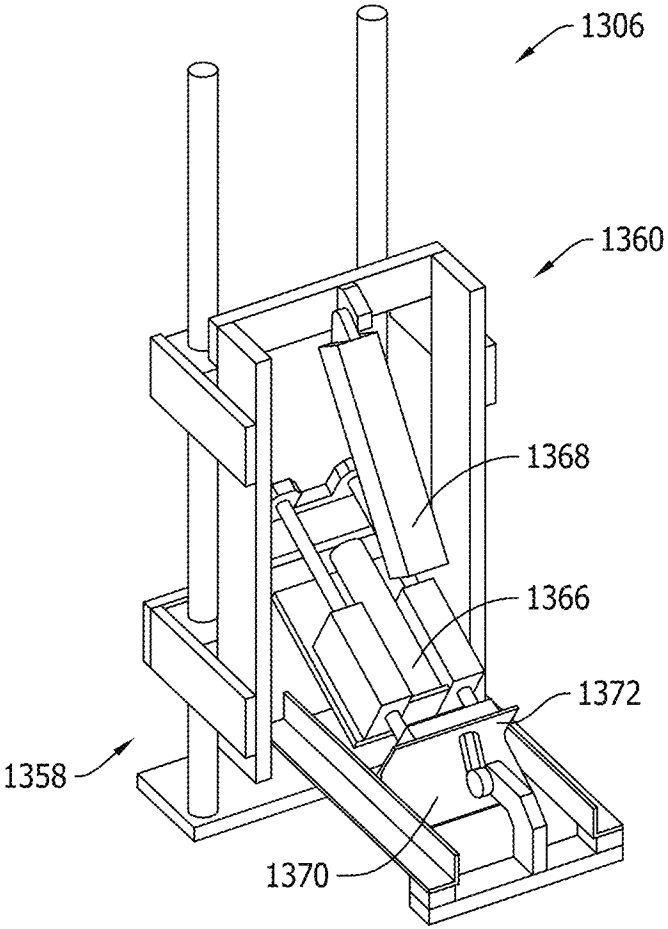
FIG. 38 is a perspective view of a glue tab folder and glue tab presser assembly included within the machine shown in FIG. 5.

As shown in FIGS. 14 and 15, pusher assembly 1206 includes a pusher servomechanism 1226 operatively coupled to a pusher bar 1228. Pusher assembly 1206 further includes a plurality of pusher feet 1230 fixedly coupled to pusher bar 1228. At least one sensor 1232, such as a photo eye, is positioned adjacent transfer assembly 1202, and more particularly, adjacent pusher assembly 1206, to determine at least a size of blank 20, as described in more below. Pusher assembly 1206 operates in synchronism with pick-up assembly 1204 to move blanks 20 from pick-up assembly 1204 to mandrel wrap section 1300. More specifically, pusher servomechanism 1226 drives pusher bar 1228 in a direction parallel to direction X, and pusher feet 1230 contact a trailing edge 126 (shown in FIG. 1) of a blank 20 and push blank 20 toward mandrel wrap section 1300. Servomechanism 1226 then reverses direction and moves pusher bar 1228 in a direction opposite to direction X to pick up the next blank 20 from pick-up assembly 1204.

Figure 12:
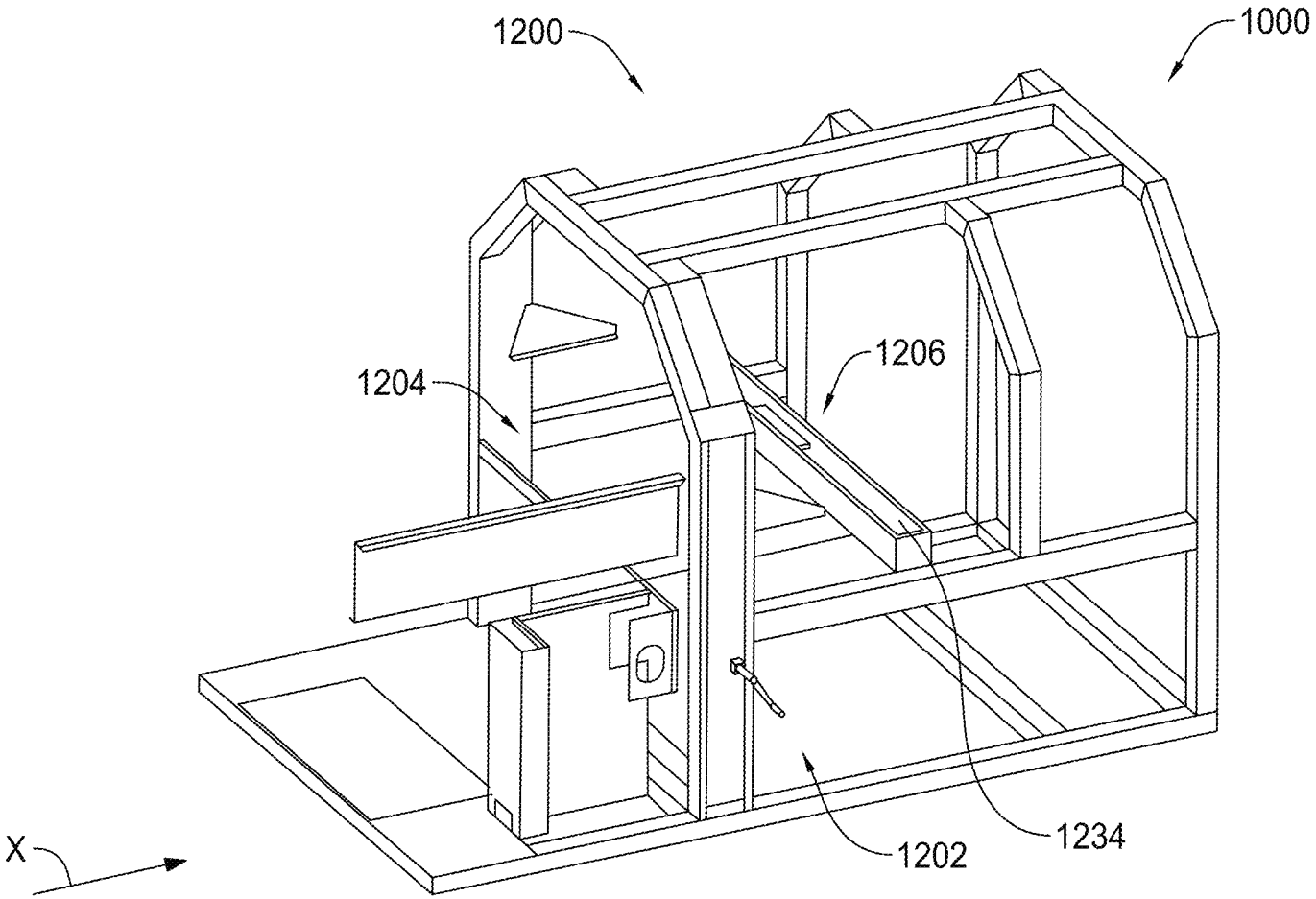
FIG. 12 is a perspective view of a portion of the vacuum transfer section including a rail transfer mechanism as shown in FIG. 7.

Referring to FIG. 12, in the exemplary embodiment, an adhesive applicator 1234 is positioned adjacent transfer assembly 1202, such as adjacent pusher assembly 1206, to apply adhesive to blank 20 as blank 20 is transferred to mandrel wrap section 1300. Adhesive applicator 1234 is coupled in communication with control system 1004. Control system 1004 controls a starting time, a pattern, an ending time, a length of adhesive bead, and/or any other suitable operations of adhesive applicator 1234. In the exemplary embodiment, control system 1004 receives an output from sensor 1232 indicating a depth of blank 20, for example, a distance between a leading edge 128 and trailing edge 126 of blank 20 (both shown in FIG. 1). Based on the depth and/or distance of blank 20 and/or a speed of transfer assembly 1202 moving blank 20 past adhesive applicator 1234, control system 1004 instructs adhesive applicator 1234 to apply adhesive to blank 20. In one embodiment, control system 1004 instructs adhesive applicator 1234 to apply adhesive to predetermined panels of blank 20. As shown in FIGS. 7-15, pick-up assembly 1204 and pusher assembly 1206 may include any suitable structure and/or means that may be used to attach to blank 20 and transfer blank 20 from magazine feed section 1100 to mandrel wrap section 1300 without departing from the scope of the present invention.

FIGS. 16-40 illustrate various portions and perspectives of mandrel wrap section 1300. Blanks 20 are received in mandrel wrap section 1300 from vacuum transfer section 1200. Mandrel wrap section 1300 includes a mandrel assembly 1302, a lift assembly 1304, a folding assembly 1306, a bottom folder assembly 1308, and an ejection assembly 1310.

FIGS. 18-22 and 43 illustrate various portions and perspectives of mandrel assembly 1302, as well as portions of lift assembly 1304, folding assembly 1306, bottom folder assembly 1308, and ejection assembly 1310. Mandrel assembly 1302 includes a mandrel 1312 having a plurality of faces 1314, 1316, 1318, 1320, 1322, 1324, 1326, and 1328 that substantially correspond to at least some of the panels on blank 20. Alternatively, mandrel 1312 does not include side faces 1316 and/or 1324. In the exemplary embodiment, mandrel 1312 includes a first corner face 1314, a first side face 1316, a second corner face 1318, a bottom face 1320, a third corner face 1322, a second side face 1324, a fourth corner face 1326, and a top face 1328. Corner faces, or miter faces, 1314, 1318, 1322, and 1326 each extend at an angle between top face 1328 and one of side faces 1316 and/or 1324 or bottom face 1320 and one of side faces 1316 and/or 1324. Any of the mandrel faces can be solid plates, frames, plates including openings defined therein, and/or any other suitable component that provides a face and/or surface configured to enable a container to be formed from a blank as described herein.

As discussed above, adhesive applicator 1234 applies adhesive to certain predetermined panels and/or flaps of blank 20 before blank is positioned adjacent mandrel 1312 and/or while blank 20 is positioned adjacent mandrel 1312. For example, adhesive applicator 1234 may apply adhesive to bottom/exterior surfaces of glue panel 38, first bottom end panel 96, and/or second bottom end panel 102 and/or to top/interior surfaces of first corner panel 22, first bottom side panel 62, and/or second bottom side panel 68 (all shown in FIG. 1). However, as discussed above, adhesive may be applied to interior and/or exterior surfaces of any suitable panel and/or flap of blank 20. After adhesive is applied by adhesive applicator 1234, blank 20 is positioned under mandrel 1312. In the exemplary embodiment, second side panel 32 is positioned below bottom face 1320 of mandrel 1312 by pusher assembly 1206.

FIGS. 23-40 illustrate various portions of lift assembly 1304, as well as portions of mandrel assembly 1302, folding assembly 1306, bottom folder assembly 1308, ejection assembly 1310, and outfeed section 1400. More specifically, lift assembly 1304 includes a first lift mechanism 1330, a second lift mechanism 1332, and an under plate assembly 1334 each coupled to a lifting frame 1336, which is coupled to frame 1002. First lift mechanism 1330 includes a servomechanism 1338, second lift mechanism 1332 includes a servomechanism 1340, and under plate assembly 1334 includes a servomechanism 1342. Servomechanisms 1338, 1340, and/or 1342 are each controlled separately to lift blank 20 toward and/or against mandrel assembly 1302. As such, lift assembly 1304 is positioned adjacent mandrel assembly 1302. In the exemplary embodiment, lift assembly 1304 receives blank 20 from transfer assembly 1202 and lifts blank 20 toward mandrel assembly 1302. For example, under plate assembly 1334 includes a plate 1344 that lifts second side panel 32 toward bottom face 1320 of mandrel 1312. Lift mechanisms 1330 and 1332 assist folding assembly 1306 in wrapping blank 20 about mandrel 1312, as described in more detail below.

Folding assembly 1306 includes a lateral presser arm 1346 having an engaging bar 1348; a folding arm 1350 having a squaring bar 1352, an engaging bar 1354, and a miter bar 1356; a glue panel folder assembly 1358; a glue panel presser assembly 1360; and a plurality of servomechanisms 1362, 1364, 1366, and 1368. These assemblies also include devices such as, but not limited to, guide rails and mechanical fingers (not shown). In the exemplary embodiment, lateral presser arm 1346 is coupled to first lift mechanism 1330 at a servomechanism 1362, and folding arm 1350 is coupled to second lift mechanism 1332 at a servomechanism 1364. Glue panel folder assembly 1358 and glue panel presser assembly 1360 are positioned adjacent first miter face 1314 of mandrel 1312. As such, glue panel folder assembly 1358 and glue panel presser assembly 1360 are positioned above lateral presser arm 1346 and first lift mechanism 1330.

Referring to FIGS. 23-39 and 43, lateral presser arm 1346 and/or first lift mechanism 1330 are configured to wrap a first portion of blank 20 about mandrel 1312, and folding arm 1350 and/or second lift mechanism 1332 are configured to wrap a second portion of blank 20 about mandrel 1312. More specifically, lateral presser arm engaging bar 1348 is configured to contact fourth corner panel 34, second end panel 36, and/or glue panel 38 and fold panels 34, 36, and/or 38 about mandrel 1312 as lateral presser arm 1346 is rotated by servomechanism 1362 and/or lifted by first lift mechanism 1330 and servomechanism 1338. Folding arm engaging bar 1354 is configured to contact the second portion of blank 20 to wrap blank 20 about mandrel 1312 as folding arm 1350 is rotated by servomechanism 1364 and/or lifted by second lift mechanism 1332 and servomechanism 1340. Miter bar 1356 is configured to contact second corner panel 26 to position second corner panel 26 adjacent to and/or against fourth miter face 1326 of mandrel 1312. Squaring bar 1352 is configured to contact first end panel 28 adjacent fold line 44 between first end panel 28 and second corner panel 26. As such, squaring bar 1352 facilitates aligning and folding panels 26 and 28 against mandrel 1312 as the second portion of blank 20 is wrapped about mandrel 1312.

Glue panel folder assembly 1358 includes an angled plate 1370 having a face substantially parallel to mandrel face 1314. Plate 1370 is coupled to a servomechanism 1366 that controls movements of plate 1370 toward and away from mandrel 1312. Plate 1370 is configured to contact and/or fold glue panel 38 during formation of container 200. In the exemplary embodiment, plate 1370 is configured to rotate glue panel 38 about fold line 54 towards and/or into contact with mandrel face 1314. Glue panel presser assembly 1360 includes a presser bar 1372 having a pressing surface substantially parallel to mandrel face 1314. Presser bar 1372 is coupled to a servomechanism 1368 that controls movement of presser bar 1372 toward and away from mandrel 1312. Presser bar 1372 is configured to contact and/or fold first corner panel 22 and/or glue panel 38 to form container 200. In the exemplary embodiment, presser bar 1372 is configured to press first corner panel 22 and glue panel 38 together against mandrel face 1314 to form a manufacturing joint at first corner wall 204 of container 200.

Bottom folder assembly 1308 includes a pair of side arms 1374 and 1376, an upper arm 1378, and a lower plate 1380. Each arm 1374, 1376, and 1378 and lower plate 1380 includes a servomechanism 1382, 1384, 1386, or 1388 such that each arm 1374, 1376, and 1378 and lower plate 1380 can be individually controlled in terms of speed, force, rotation, extension, retraction, and/or any other suitable movements. Side arms 1374 and 1376 are configured to fold bottom end panels 102 and 96, respectively, about fold lines 106 and 100. Upper arm 1378 is configured to fold first bottom side panel 62 about fold line 66, and lower plate 1380 is configured to fold second bottom side panel 68 about fold line 72. Lower plate 1380 is further configured to press bottom panels 62, 68, 96, and/or 102 together to form bottom wall 222 of container 200. In the exemplary embodiment, each arm 1374, 1376, and 1378 includes a roller that contacts a respective panel of blank 20; however, it should be understood that arm 1374, 1376, and/or 1378 can include any suitable contacting surface. Further, lower plate 1380 is configured to lay flat in a first position and rotate toward mandrel 1312 to a second position. When lower plate 1380 is in the first position, container 200 can be ejected from mandrel 1312 over lower plate 1380 to outfeed section 1400. When lower plate 1380 is in the second position, lower plate 1380 compresses bottom panels 62, 68, 96, and/or 102 together.

Ejection assembly 1310 includes an ejection plate 1390 moveable from a first position within mandrel 1312 to a second position downstream from mandrel 1312. When ejection plate 1390 is at the first position, bottom folder assembly 1308 folds and/or presses bottom panels 62, 68, 96, and/or 102 against ejection plate 1390 to form bottom wall 222 of container 200. When ejection plate 1390 is at the second position, container 200 is removed from mandrel 1312. In the exemplary embodiment, ejection plate 1390 includes a servomechanism 1392 that controls speed, force, rotation, extension, retraction, and/or any other suitable movements of ejection plate 1390.

Figure 40:
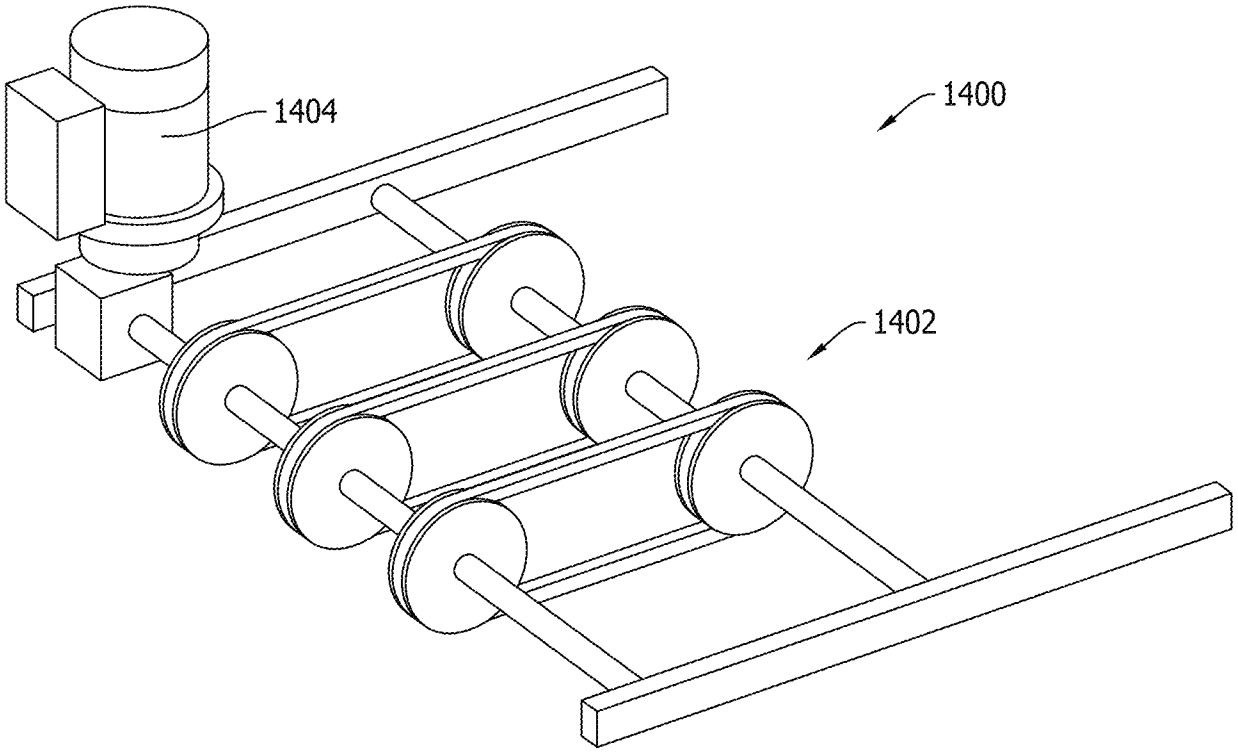
FIG. 40 is a perspective view of another portion of the outfeed assembly shown in FIG. 35.

Referring to FIG. 40, outfeed section 1400 includes a conveyor assembly 1402 that moves containers 200 from mandrel wrap section 1300 toward product load section 1500. More specifically, conveyor assembly 1402 is positioned downstream from mandrel wrap section 1300 such that ejection plate 1390 is above conveyor assembly 1402 when ejection plate 1390 is at its second position. Conveyor assembly 1402 includes a servomechanism 1404 configured to remove container 200 from machine 1000 at a predetermined speed and timing. In the exemplary embodiment, conveyor assembly 1402 is servo-controlled in synchronism with ejection plate 1390 such that conveyor assembly 1402 is only activated when container 200 is being ejected from mandrel wrap section 1300. Alternatively, conveyor assembly 1402 is constantly activated while machine 1000 is forming containers 200.

During operation of machine 1000 to form container 200, blank 20 is positioned under mandrel assembly 1302 by transfer assembly 1202. Referring to FIGS. 5-40 and 43, when blank 20 is positioned adjacent mandrel 1312, under plate assembly 1334 is raised upwardly relative to blank 20 using servomechanism 1342, and lifting frame 1336 remains stationary. In the exemplary embodiment, under plate 1344 lifts second side panel 32 to be adjacent to and/or in contact with bottom face 1320 of mandrel 1312. First and second lift mechanisms 1330 and 1332 are raised using servomechanisms 1338 and 1340 that are used to individually control each of lift mechanisms 1330 and 1332, respectively. Lift mechanisms 1330 and 1332 engage at least end panels 36 and 28, respectively, of blank 20 and begin to wrap blank 20 around mandrel 1312 as lift mechanisms 1330 and 1332 move upwardly.

Lateral presser arm 1346 wraps the first portion of blank 20 around mandrel 1312 as first lift mechanism 1330 is raised using an associated servomechanism 1338. More specifically, as first lift mechanism 1330 is raised using servomechanism 1338, lateral presser arm 1346 is lifted by first lift mechanism 1330 and/or rotated toward mandrel 1312 using servomechanism 1362. Alternatively, lateral presser arm 1346 is not rotated as first lift mechanism 1330 lifts lateral presser arm 1346. In the exemplary embodiment, as lateral presser arm 1346 rotates and moves upward, lateral presser arm 1346 rotates at least fourth corner panel 34 toward second miter face 1318 of mandrel 1312 and second end panel 36 toward first side face 1316 of mandrel 1312. As lateral presser arm 1346 is lifted and/or rotated, servomechanism 1366 moves glue panel folder assembly 1358 toward glue panel 38 to rotate glue panel 38 toward first miter face 1314 of mandrel 1312.

Folding arm 1350 wraps the second portion of blank 20 around mandrel 1312 as second lift mechanism 1332 is raised using an associated servomechanism 1340. After lifting and/or during lifting, folding arm 1350 is rotated such that engaging bar 1354, miter bar 1356, and squaring bar 1352 further wrap blank 20 around mandrel 1312. Miter bar 1356 and squaring bar 1352 position blank 20 in face-to-face contact with mandrel faces 1324, 1326, and 1328 at panels 28, 26, and 24, respectively. Once folding arm 1350 has wrapped the second portion of blank 20 about mandrel 1312, servomechanism 1368 moves glue panel presser assembly 1360 toward first corner panel 22 and/or glue panel 38 to press first corner panel 22 and glue panel 38 together against mandrel 1312. Glue panel folder assembly 1358 and/or glue panel presser assembly 1360 rotates first corner panel 22 about fold line 40. Servomechanism 1368 holds glue panel presser assembly 1360 against panels 22 and 38 for a predetermined time period and/or duration to ensure that adhesive bonds panels 22 and 38 together. Accordingly, lateral presser arm 1346, folding arm 1350, glue panel folder assembly 1358, and glue panel presser assembly 1360 cooperate to fold blank 20 along fold lines 40, 42, 44, 46, 48, 50, 52, and 54 to form container 200.

Because glue panel presser assembly 1360 is servo-controlled, the predetermined time period and/or duration can be set based on the size and/or type of container, a material of the container, a type of adhesive and/or any other suitable variables. Further, because lateral presser arm 1346 and folding arm 1350 are servo-controlled, once first lift mechanism 1330 is at a predetermined location, lateral presser arm 1346 can be rotated inwardly toward mandrel 1312 by servomechanism 1362 to further wrap blank 20 about and/or press blank 20 into contact with mandrel 1312. Similarly, once second lift mechanism 1332 reaches a predetermined location, folding arm 1350 is rotated toward mandrel 1312 using servomechanism 1364 that controls the speed, force, and location of folding arm 1350 to further wrap blank 20 about mandrel 1312.

Bottom folder assembly 1308 then rotates bottom panels 62, 68, 96, and 102 about fold lines 66, 72, 100, and 106. More specifically, side arms 1374 and 1376 rotate bottom end panels 102 and 96, respectively, against ejection plate 1390; upper arm 1378 rotates first bottom side panel 62 against bottom end panels 96 and/or 102 and/or against ejection plate 1390; and then lower plate 1380 rotates second bottom side panel 68 against panels 62, 96, and/or 102 and/or against ejection plate 1390. Lower plate 1380 presses panels 62, 68, 96, and/or 102 against ejection plate 1390 for a predetermined period and/or duration of time to ensure that adhesive bonds panels 62, 68, 96, and/or 102 together. Because each arm 1374, 1376, and 1378 and lower plate 1380 are servo-controlled, each component of bottom folder assembly 1308 can be individually controlled to form any size and/or type of container from any suitable container material using any suitable type of adhesive.

Ejection assembly 1310 facilitates removal of formed container 200 from mandrel wrap section 1300 to outfeed section 1400. More specifically, ejection plate 1390 applies a force to bottom wall 222 of container 200 to remove container 200 from mandrel 1312. In the exemplary embodiment, ejection plate 1390 is at a first position within and/or adjacent to mandrel 1312 during formation of container 200. To remove container 200, ejection plate 1390 is moved to a second position adjacent outfeed section 1400. As ejection plate 1390 is moved, container 200 is moved toward outfeed section 1400. At outfeed section 1400 container 200 is conveyed downstream from machine 1000 for loading and/or top wall formation by conveyor assembly 1402. For example, after container 200 is formed and a product is placed inside container 200, top panels 60, 70, 84, and 104 are closed to form top wall 224 for shipping of the product.

Figure 41:
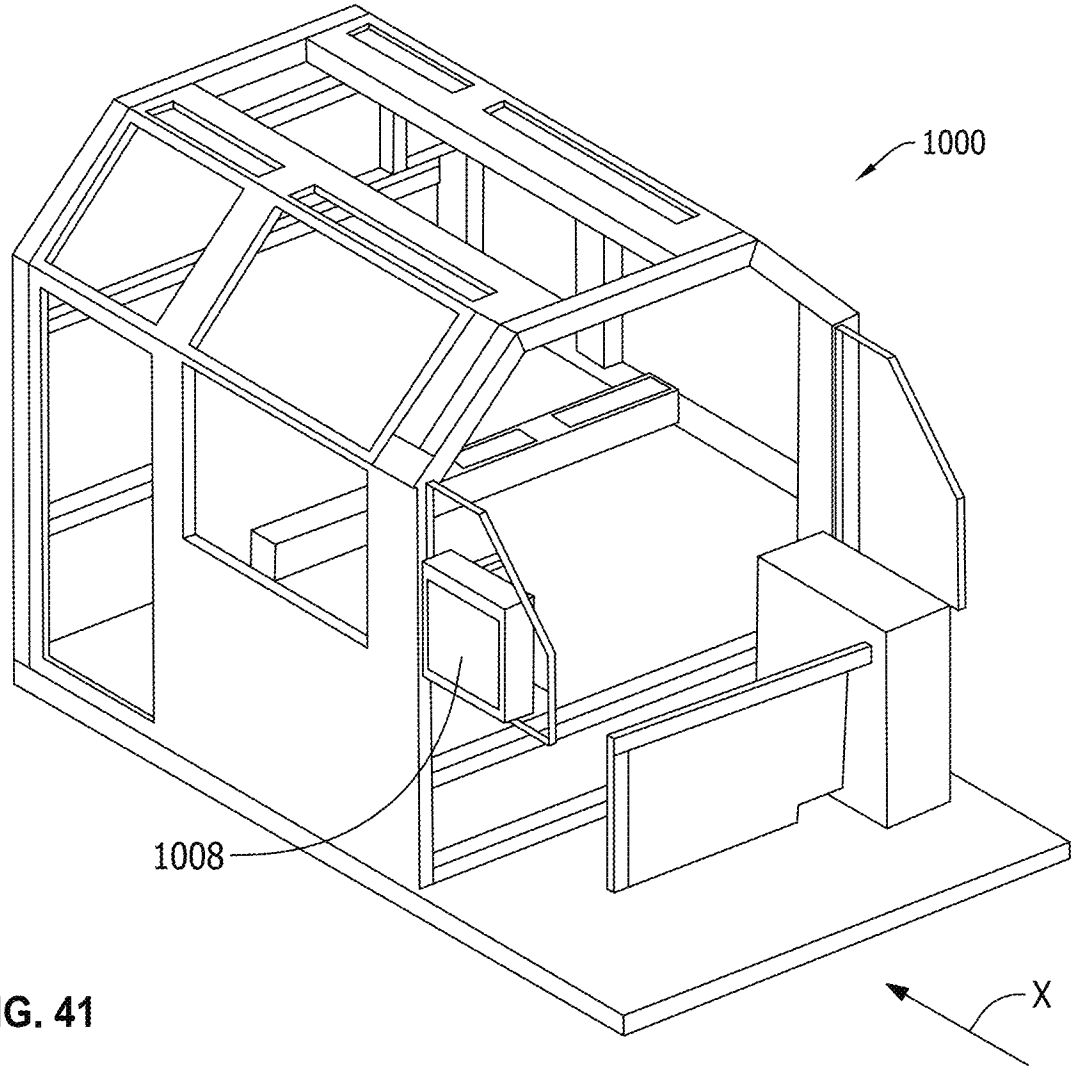
FIG. 41 is a perspective view of a portion of an exemplary control system that is part of the machine shown in FIGS. 5 and 6.
Figure 42:
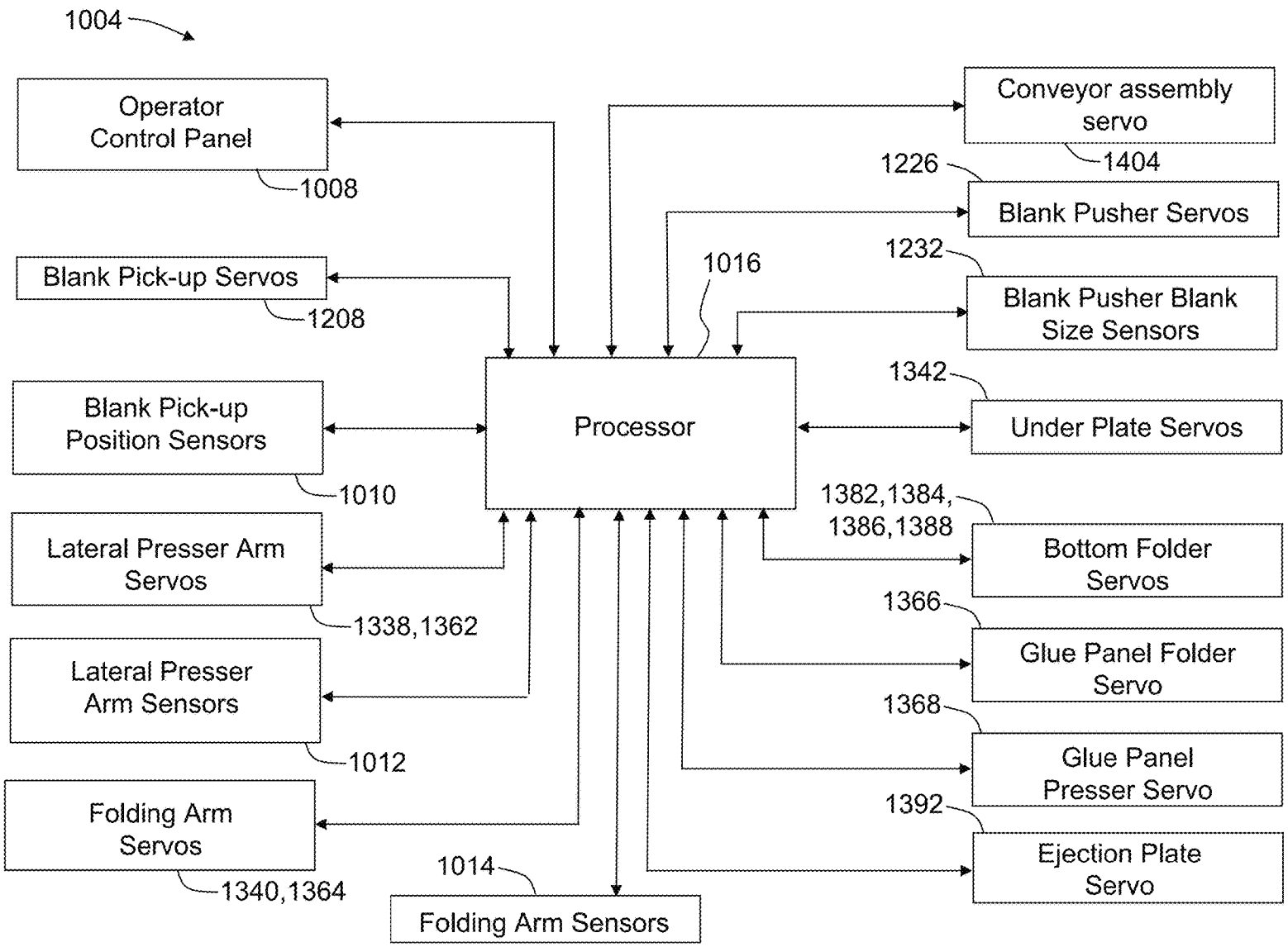
FIG. 42 is a schematic view of the control system that is part of the machine shown in FIGS. 5 and 6.
Figure 43:
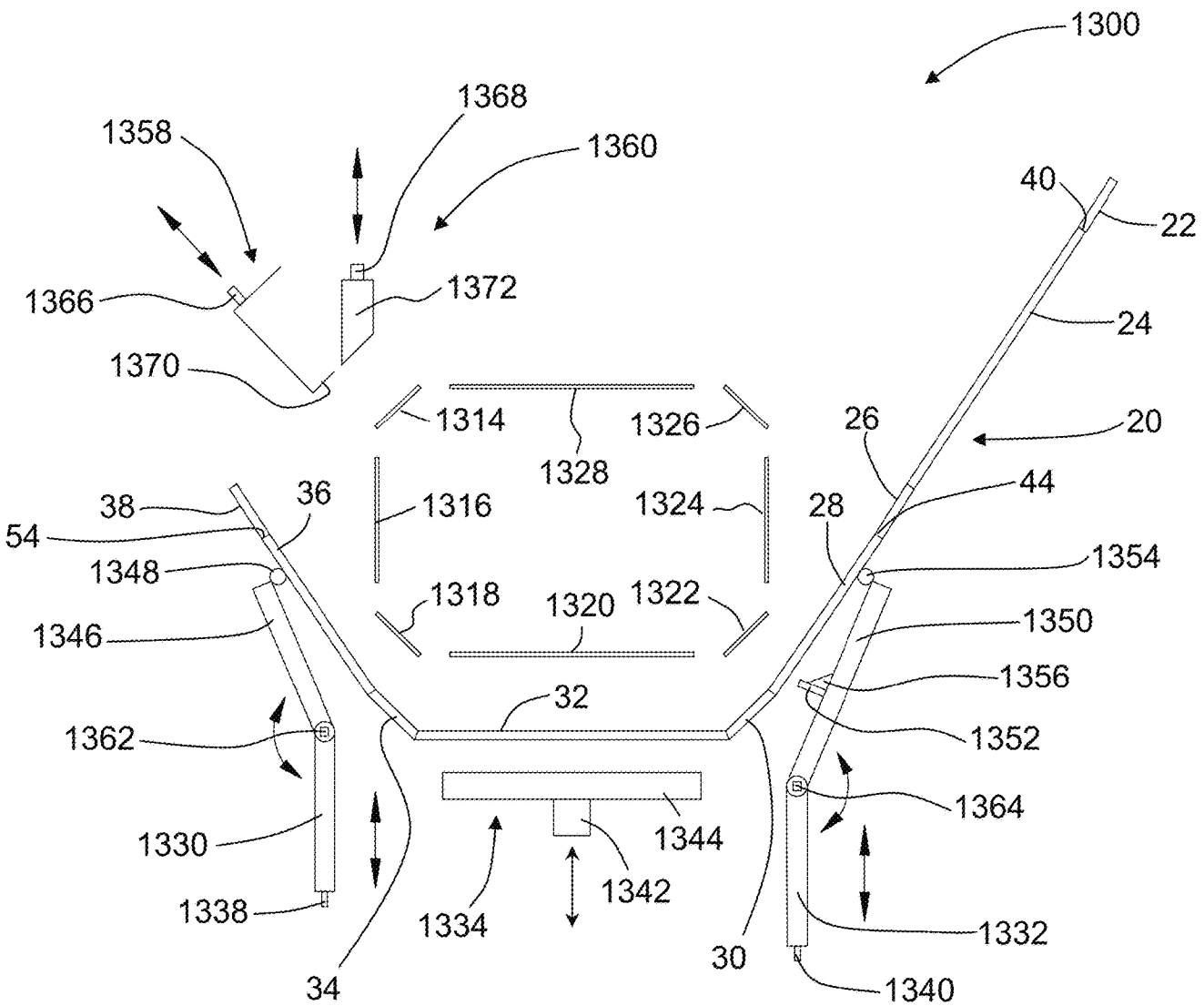
FIG. 43 is a schematic view of the mandrel assembly and lift assembly shown in FIGS. 16-34.

FIG. 41 is a perspective view of a portion of an exemplary control system 1004 that may be used to control machine 1000 shown in FIGS. 5 and 6. More specifically, FIG. 41 illustrates positioning of an operator control panel or user interface 1008 on machine 1000. FIG. 42 is a schematic view of control system 1004 that may be used with machine 1000 shown in FIGS. 5 and 6. Machine 1000 is configured to assemble containers of any size and any shape without limitation. Therefore, to accommodate machine 1000's assembly of such a large variety of containers, machine control system 1004 is configured to automatically detect dimensional features of blanks 20 of varying shapes and sizes, including, but not limited to, length, width, and/or depth.

In the exemplary embodiment, machine 1000 includes at least a blank pick-up position sensor 1010, a lateral presser arm sensor 1012, a folding arm sensor 1014, and blank pusher blank size sensor 1232. Further each servomechanism can include a sensor. Sensors 1010, 1012, 1014, and/or 1232 can be any suitable sensors, such as infra-red type sensors, or photo-eye sensors. Alternatively, any sensors that enable operation of control system 1004 and machine 1000, as described herein are used. Servomechanisms 1208, 1226, 1338, 1340, 1342, 1362, 1364, 1366, 1368, 1382, 1384, 1386, 1388, 1392, and 1404 and sensors 1010, 1012, 1014, and 1232 are integrated within machine control system 1004, as described herein.

Control system 1004 also includes at least one processor 1016. Preprogrammed recipes or protocols are programmed in and/or uploaded into processor 1016 and such recipes include, but are not limited to, predetermined speed and timing profiles, wherein each profile is associated with blanks of a predetermined size and shape. Control panel 1008 allows an operator to select a recipe that is appropriate for a particular blank. The operator typically does not have sufficient access rights/capabilities to alter the recipes; although select users can be given privileges to create and/or edit recipes. Each recipe is a set of computer instructions that instruct machine 1000 as to forming the container. For example, machine 1000 is instructed as to speed and timing of picking a blank from magazine feed section 1100, speed and timing of transferring the blank under mandrel 1312, speed and timing of lifting the blank into contact with mandrel 1312, speed and timing of moving lateral presser arm 1346, speed and timing of moving folding arm 1350, speed and timing of bottom folder assembly 1308, and speed and timing of transferring the formed container to outfeed section 1400. Since each component is individually controlled by a servomechanism, control system 1004 is able to control the movement of each component of machine 1000 relative to any other component of machine 1000. This enables an operator to maximize the number of containers that can be formed by machine 1000, easily change the size of containers being formed on machine 1000, and automatically change the type of containers being formed on machine 1000 without manually adjusting machine 1000. As used herein, a type of container refers to containers having the same number of sides and the same overall length of the blank, but may have different depth dimensions and/or top panel configurations. Further, as used herein, a size of container refers to containers that may have different numbers of sides, different blank length dimensions, different blank depth dimensions, and/or different top panel configurations.

As illustrated in FIG. 42, processor 1016 is coupled in communication with servomechanisms 1208, 1226, 1338, 1340, 1342, 1362, 1364, 1366, 1368, 1382, 1384, 1386, 1388, 1392, and 1404 and sensors 1010, 1012, 1014, and 1232. Servomechanisms 1208, 1226, 1338, 1340, 1342, 1362, 1364, 1366, 1368, 1382, 1384, 1386, 1388, 1392, and 1404 independently drive and position the associated devices and/or components as commanded by processor 1016. Sensors 1010, 1012, 1014, and 1232 independently generate and transmit real-time feedback signals to processor 1016 that are substantially representative of a position of a blank within machine 1000. Control system 1004 is configured to facilitate programming a plurality of component speeds and timing of movement within each recipe. That is, for a particular cycle of a component, the speed of that component as driven by the associated servomechanism can vary at any point in the cycle. Additionally, the timing of the movement can also be controlled by servomechanisms 1208, 1226, 1338, 1340, 1342, 1362, 1364, 1366, 1368, 1382, 1384, 1386, 1388, 1392, and/or 1404 and/or control system 1004.

For example, referring to FIGS. 7-15, in pick-up assembly 1204, servomechanism 1208 is operatively coupled to pick-up bar 1216, and suction cups 1220 are coupled to pick-up bar 1216. For larger blanks 20, the preprogrammed recipe typically drives pick-up bar 1216 from a start position towards a next available blank 20. As suction cups 1220 approach blank 20, servomechanism 1208 decelerates pick-up bar 1216 such that an affirmative capture of blank 20 by suction cups 1220 is achieved, or decelerates pick-up bar 1216 to a neutral position until machine 1000 is ready for the next blank 20. In the neutral position, suction cups 1220 are not attached to a blank 20. Servomechanism 1208 then drives pick-up bar 1216 to insert blank 20 into mandrel wrap section 1300 at a predetermined speed that reduces a potential for blank 20 to become prematurely disengaged from suction cups 1220. Once blank 20 is disengaged from suction cups 1220 at the appropriate location, servomechanism 1208 drives pick-up bar 1216 at an accelerated speed to reduce any latency period between insertion of blanks 20 into mandrel wrap section 1300. The ability to control the speed and timing of pick-up bar 1216 enables machine 1000 to form different size containers including larger containers from larger blanks that may require slower movements when feeding the blanks into machine 1000, and improves the output of machine 1000 by accelerating pick-up bar 1216 at time periods in which pick-up bar 1216 can move more quickly and decelerating pick-up bar 1216 during time periods in which pick-up bar 1216 should move more slowly.

Control system 1004 for pick-up assembly 1204 facilitates reliable operation of machine 1000, for example, by using the feedback from the sensor to delay the next pick-up of a blank 20, if the previous blank 20 is in mandrel assembly 1302. In this situation, pick-up servomechanism 1208 will stop the motion of pick-up bar 1216 and associated suction cups 1220 until the previous blank 20 is cleared from mandrel wrap section 1300. This feature (i.e., the ability to hold pick-up bar 1216 at the neutral location to wait for the previous blank to clear mandrel assembly 1302) reduces the amount of compressed air that is used by machine 1000 because suction cups 1220 are not attached to the blank that will be fed through machine 1000 next, and reduces wear of suction cups 1220 because suction cups 1220 are not in contact with the blank when in the neutral position. Rather, pick-up bar 1216 is held in the neutral position until the previous blank clears mandrel assembly 1302, at which time control system 1004 instructs pick-up servomechanism 1208 to move pick-up bar 1216 from the neutral position to a pick up position. At that time, the compressed air is also activated.

Control system 1004 is also configured to facilitate dynamic control of the container-forming process. More specifically, if the blanks to be formed into containers are not uniform with respect to, for example, the associated depth dimension (i.e., the depth or height of the box), the sensors will generate and transmit a signal to processor 1016 that will alter the movement of the drives driven by the associated servomechanisms to accommodate the differing depth dimensions dynamically. For example, in the event that vacuum transfer section 1200's pusher assembly 1206 senses that a particular blank has a greater depth than a previous blank (or control system 1004 instructs machine 1000 either via sensors or operator input that the blank has a different depth dimension), such dimension feedback to processor 1016 will induce processor 1016 to adjust a stroke of pusher assembly 1206 to accommodate the varying blank depths.

One method of determining depth of a blank 20 is to have two sensors 1232, that is, a first sensor for sensing leading edge 128 of a blank 20 and a second sensor for sensing trailing edge 126 of the blank 20, and transmitting the associated signals to processor 1016 that subsequently uses an algorithm to compute a length and/or a depth of that particular blank 20. In addition to adjusting a servomechanism's range of driving movement, for example, adjusting a push stroke distance, dynamic depth measurements also facilitate adjusting a number of and/or a length of glue beads that are applied to blank 20 during the container forming process. The servomechanisms and sensors in mandrel wrap section 1300 also facilitate controlled container formation by independently adjusting vertical movement of lateral presser arm 1346 and folding arm 1350 and rotational movement of at least folding arm 1350.

In one aspect, a machine for forming a container from a blank of sheet material is provided. The machine includes a frame, a blank feed mechanism mounted to the frame, a transfer assembly mounted to the frame for transferring the blank from the blank feed mechanism, a mandrel assembly mounted to the frame, and a control system. The mandrel assembly includes a mandrel having an external shape complimentary to an internal shape of at least a portion of the container, a first lifting mechanism operatively coupled to a first servo mechanism, a second lifting mechanism operatively coupled to a second servo mechanism, and a folding arm coupled to the first lifting mechanism and operatively coupled to a third servo mechanism. The control system is in communication with the first, second and third servo mechanisms, and is configured to transmit a signal to each of the servo mechanisms to independently control movement of the first lifting mechanism, the second lifting mechanism, and the folding arm for wrapping at least a portion of the blank around the mandrel.

In another aspect, a control system for controlling a box forming machine is provided. The control system includes a computer program embodied on a computer readable medium for instructing the control system. The control system is configured to transmit a first signal to a transfer assembly for instructing the transfer assembly to transfer the blank to the machine, transmit a second signal to a first servo mechanism for controlling movement of a first lifting mechanism, transmit a third signal to a second servo mechanism for controlling movement of a second lifting mechanism, and transmit a fourth signal to a third servo mechanism for controlling movement of a folding arm, wherein the first lifting mechanism, the second lifting mechanism, and the folding arm are configured to wrap at least a portion of the blank around a mandrel.

Exemplary embodiments of methods and a machine for forming a container from a blank are described above in detail. The methods and machine are not limited to the specific embodiments described herein, but rather, components of systems and/or steps of the methods may be utilized independently and separately from other components and/or steps described herein. For example, the machine may also be used in combination with other blanks and containers, and is not limited to practice with only the blank and container described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A machine for forming a container from a blank of sheet material, said machine comprising:

a frame;

a mandrel assembly mounted to the frame, the mandrel assembly comprising:

a mandrel having an external shape complimentary to an internal shape of at least a portion of the container;

a lift assembly operatively coupled to at least one lift servomechanism wherein the lift assembly lifts the blank towards the mandrel;

a folding arm coupled to the lift assembly and operatively coupled to a folding arm servomechanism, the lift assembly configured to move the folding arm relative to the mandrel to engage and align a first portion of the blank with at least a first side face of the mandrel; and a lateral presser arm coupled to the lift assembly and operatively coupled to a lateral presser servomechanism, the lateral presser arm configured to rotate with respect to the lift assembly to engage a second portion of the blank and move the second portion into alignment with at least a second, opposite side face of the mandrel; and a control system in communication with the at least one lift servomechanism, the folding arm servomechanism, and the lateral presser servomechanism, the control system configured to transmit a signal to each of the servomechanisms to cause the blank to be wrapped about the mandrel during operation of the machine by controlling at least one of a speed and a timing of movement of the lift assembly, the folding arm, and the lateral presser arm independently of each other.

2. A machine in accordance with claim 1 further comprising:

a blank feed mechanism mounted to the frame; and a transfer assembly mounted to the frame, the transfer assembly transfers the blank from the blank feed mechanism to the mandrel assembly.

3. A machine in accordance with claim 2 further comprising:

at least one sensor positioned adjacent the transfer assembly, the at least one sensor outputs a signal to the control system indicating a depth of the blank; and an adhesive applicator positioned adjacent the transfer assembly and coupled in communication with the control system, the control system controls the adhesive applicator to apply adhesive to the blank based on the depth of the blank and a speed of the transfer assembly.

4. A machine in accordance with claim 2 wherein the transfer assembly further comprises:

a vacuum transfer mechanism operatively coupled to a vacuum transfer servomechanism, the vacuum transfer mechanism controls movement of the vacuum transfer mechanism including maintaining the vacuum transfer mechanism in a neutral position until the blank is being formed into the container and a second blank is requested by the control system; and a pusher arm mechanism operatively coupled to a pusher arm servomechanism, the pusher arm mechanism controls movement of the pusher arm mechanism to detect a leading edge of the blank and position the blank under the mandrel based on the position of the leading edge.

5. A machine in accordance with claim 4 wherein the control system is in communication with the vacuum transfer servomechanism and the pusher arm servomechanism and the control system transmits a signal to each of the vacuum transfer servomechanism and the pusher arm servomechanism to independently control movement of the vacuum transfer mechanism and the pusher arm mechanism.

6. A machine in accordance with claim 1 wherein the control system stores a plurality of container forming protocols, each protocol comprising computer instructions for forming at least one of different size containers, different types of containers, and different output of containers.

7. A machine in accordance with claim 6 wherein each protocol comprises computer instructions for controlling the at least one lift servomechanism, the folding arm servomechanism, and the lateral presser servomechanism to independently control movement of the lift assembly, the folding arm, and the lateral presser arm.

8. A machine in accordance with claim 1 further comprising an ejection plate that extends from the mandrel toward an output section of the machine, a bottom wall of the container formed against the ejection plate, and the ejection plate applies a force to the bottom wall of the container to eject the container from the mandrel.

9. A machine in accordance with claim 1 further comprising a bottom folding assembly comprising at least one bottom folding arm operatively coupled to a bottom folding servomechanism.

10. A machine in accordance with claim 9, wherein the control system further transmits a signal to the bottom folding servomechanism to independently control at least one of a speed and a timing of movement of the at least one bottom folding arm to form a bottom wall of the container.

11. A machine in accordance with claim 1, wherein the first portion of the blank includes a first end panel and the second portion of the blank includes a second end panel, and wherein the lateral presser arm is configured to contact the second end panel to move the second end panel into alignment with the second side face.

12. A machine in accordance with claim 1, wherein the lateral presser arm is further configured to engage a third portion of the blank, the third portion of the blank being adjacent to the second portion of the blank, and wherein the lateral presser arm is further configured to move the third portion into alignment with a third face of the mandrel, the third face of the mandrel being positioned between the first side face and the second side face.

13. A machine for forming a container from a blank of sheet material, said machine comprising:

a frame;

a mandrel assembly mounted to the frame, the mandrel assembly comprising:

a mandrel having an external shape complimentary to an internal shape of at least a portion of the container;

a lift assembly operatively coupled to at least one lift servomechanism wherein the lift assembly lifts the blank towards the mandrel;

a folding arm coupled to the lift assembly and operatively coupled to a folding arm servomechanism, the lift assembly moves the folding arm relative to the mandrel to wrap a first portion of the blank about the mandrel; and a lateral presser arm coupled to the lift assembly and operatively coupled to a lateral presser servomechanism, the lateral presser arm rotates with respect to the lift assembly to wrap a second portion of the blank about mandrel;

a transfer assembly mounted to the frame, the transfer assembly configured to transfer the blank from to the mandrel assembly, and comprising a pusher arm mechanism operatively coupled to a pusher arm servomechanism, wherein the pusher arm mechanism controls movement of the pusher arm mechanism to detect a leading edge of the blank and position the blank under the mandrel based on the position of the leading edge; and a control system in communication with the at least one lift servomechanism, the folding arm servomechanism, and the lateral presser servomechanism, the control system configured to transmit a signal to each of the servomechanisms to cause the blank to be wrapped about the mandrel during operation of the machine by controlling at least one of a speed and a timing of movement of the lift assembly, the folding arm, and the lateral presser arm independently of each other.

* * * * *